US012325062B2

(12) United States Patent
Shimomura et al.

(10) Patent No.: US 12,325,062 B2
(45) Date of Patent: Jun. 10, 2025

(54) CASTING MOLD SHAPING APPARATUS AND CASTING MOLD SHAPING METHOD

(71) Applicant: METALS ENGINEERING KABUSHIKI KAISHA, Takaoka (JP)

(72) Inventors: Kouichi Shimomura, Takaoka (JP); Daisuke Funaki, Takaoka (JP); Yuso Kanehira, Takaoka (JP)

(73) Assignee: METALS ENGINEERING KABUSHIKI KAISHA, Takaoka (JP)

( * ) Notice: Subject to any disclaimer, the term of this patent is extended or adjusted under 35 U.S.C. 154(b) by 0 days.

(21) Appl. No.: 18/713,744

(22) PCT Filed: Nov. 24, 2022

(86) PCT No.: PCT/JP2022/043395
§ 371 (c)(1),
(2) Date: May 28, 2024

(87) PCT Pub. No.: WO2023/195199
PCT Pub. Date: Oct. 12, 2023

(65) Prior Publication Data

US 2025/0025935 A1 Jan. 23, 2025

(30) Foreign Application Priority Data

Apr. 6, 2022 (JP) ..... 2022-063676

(51) Int. Cl.
*B22C 15/08* (2006.01)
*B22C 15/06* (2006.01)

(52) U.S. Cl.
CPC ..... *B22C 15/08* (2013.01); *B22C 15/06* (2013.01)

(58) Field of Classification Search
CPC ..... B22C 15/06; B22C 15/08
See application file for complete search history.

(56) References Cited

U.S. PATENT DOCUMENTS 4,828,007 A 5/1989 Fischer
5,682,941 A 11/1997 Oda
2002/0129917 A1 9/2002 Kaneto

FOREIGN PATENT DOCUMENTS

JP S60-5748 U 1/1985
JP S60-115346 A 6/1985
(Continued)

OTHER PUBLICATIONS

International Search Report for PCT /JP2022/043395 mailed Jan. 31, 2023.

(Continued)

*Primary Examiner* — Kevin P Kerns
*Assistant Examiner* — Steven S Ha
(74) *Attorney, Agent, or Firm* — Schmeiser, Olsen & Watts LLP

(57) ABSTRACT

A casting mold shaping apparatus is provided that includes: a pressing member for pressing charged casting sands in a molding space formed by a molding flask and a carrier plate placed on a squeezing table; a driving mechanism for performing driving so as to bring the pressing member and the squeezing table close to each other or separate that pressing member and the squeezing table from each other, the driving mechanism including an output unit that relatively moves along a direction of pressing the pressing member; an electric motor for driving the driving mechanism; and a pressure adjustment device for adjusting a force of the driving mechanism outputted to the output unit so as to decrease and causing the pressing member to generate a predetermined pressing force necessary for pressing the casting sands, are included.

10 Claims, 20 Drawing Sheets

(56) References Cited

FOREIGN PATENT DOCUMENTS

| | | | |
|---|---|---|---|
| JP | H01-127136 | A | 5/1989 |
| JP | H08-164444 | A | 6/1996 |
| JP | H11-207440 | A | 8/1999 |
| JP | 2002-273547 | A | 9/2002 |
| JP | 2004-017089 | A | 1/2004 |

OTHER PUBLICATIONS

Microfilm of the specification and drawings annexed to the request of Japanese Utility Model 1-10 Application No. 95790/1983 (Laid-open No. JPS605748/1985) (Mitsubishi Heavy Ind Ltd) Jan. 16, 1985 (Jan. 16, 1985). entire text.

CASTING MOLD SHAPING APPARATUS AND CASTING MOLD SHAPING METHOD

CROSS-REFERENCE TO RELATED APPLICATIONS

This application is a national stage of PCT Application No. PCT/JP2022/043395, having a filing date of Nov. 24, 2022, based on Japanese Application No. 2022-063676, having a filing date of Apr. 6, 2022, the entire contents both of which are hereby incorporated by reference.

FIELD OF TECHNOLOGY

The following relates to a casting mold shaping apparatus for making a mold by using casting sands and a casting mold shaping method therefor.

BACKGROUND

In order to make a mold, the inside of a molding space formed by a pattern surface plate on which a pattern is placed and fixed, and a molding flask, is filled with casting sands. By pressing the casting sands which have been charged and extracting the pattern therefrom, a mold made of sands is formed.

Such a casting mold shaping apparatus for manufacturing a mold commonly uses an actuator including a hydraulic cylinder to press (squeeze) casting sands in a molding flask.

However, in most cases, a hydraulic pressure generation device which functions as a pressure source of the hydraulic cylinder, is operated at all times during the operation of a facility, and is a device that uses a particularly large amount of power, and thus a large running cost is required.

Therefore, in recent years, in order to save energy by reducing power consumption, a de-hydraulic cylinder has been examined, and the electrification of actuators has been promoted.

As an example of such electrification, in JPH08-164444A, a squeezing plate (pressing member) is raised and lowered using a linear-motion-type electric cylinder using a servomotor.

The electric cylinder is generally configured by a screw and a nut of a ball screw mechanism. In a control method, a pressing force against casting sands is generally converted into a motor torque of a servomotor to perform torque control.

JP2004-017089A describes a press machine that converts rotational motions into linear motions by a crank shaft and a connecting rod using a servomotor.

However, in JPH08-164444A and JP2004-017089A, since a servomotor is used as a prime mover, the operation thereof requires complicated control. Therefore, there have been problems in terms of an increase in expenses for facilities, and maintenance. In addition, since the molding speed can be reduced in a molding facility with a small production volume, there is a case where it is not necessary to perform acceleration and deceleration positioning in a short time by servomotor control, and it has been desired to reduce the expenses for facilities and simplify an apparatus.

In addition, the ball screw mechanism is configured by precision components, and has a defect that trouble occurs due to the influence of powder dust in a foundry, and a problem in terms of maintenance.

In addition, in the casting mold shaping, it is necessary to change the height of the mold for each squeeze depending on the properties (degree of compression) of the casting sands in a molding flask and the pattern shape. However, there is a problem regarding such a change that the press machine of JP2004-017089A can insufficiently deal with an issue of outputting an appropriate pressing force.

SUMMARY

An aspect relates to a casting mold shaping apparatus capable of reducing facility costs and squeezing casting sands using an electric motor to mold, and to provide a molding method used for the molding.

According to the casting mold shaping apparatus of a first aspect of embodiments of the present invention includes: a pressing member for pressing charged casting sands in a molding space formed by a molding flask and a carrier plate placed on a squeezing table; and a driving mechanism for performing driving so as to bring the pressing member and the squeezing table close to each other or separate the pressing member and the squeezing table from each other, the driving mechanism including an output unit that moves along a direction of pressing the pressing member.

Includes furthermore: an electric motor for driving the driving mechanism; and a pressure adjustment device for adjusting a force of the driving mechanism outputted to the output unit so as to decrease and causing the pressing member to generate a predetermined pressing force necessary for pressing the casting sands, are included.

Accordingly, a force generated when the driving mechanism moves the output unit is adjusted so as to be reduced by the pressure adjustment device and transmitted to the pressing member. As a result, it is possible to press the casting sands by generating a predetermined pressing force in the pressing member in response to a change in the degree of compression of the casting sands or the height of the mold which varies every time molding is performed.

According to the casting mold shaping apparatus of a second of embodiments of the present invention, in the casting mold shaping apparatus of the first aspect, the driving mechanism makes a fluctuation in a force generated in the output unit, and the pressure adjustment device adjusts a fluctuating force of the driving mechanism outputted to the output unit so as to decrease.

Accordingly, a fluctuating force generated when the driving mechanism moves the output unit is adjusted so as to be reduced by the pressure adjustment device and transmitted to the pressing member.

According to the casting mold shaping apparatus of a third aspect of embodiments of the present invention, in the casting mold shaping apparatus of the second aspect, the pressure adjustment device includes a hydraulic cylinder that receives a pressing force of the pressing member and a pressure control valve that controls a back pressure of the hydraulic cylinder, and the pressing member comprises a plurality of squeezing feet.

Accordingly, the pressing force of the squeezing foot can be adjusted in accordance with the shape of the pattern and the properties of the casting sands, and the pressing can be performed with an appropriate pressing force.

According to the casting mold shaping apparatus of a fourth aspect of embodiments of the present invention, in the casting mold shaping apparatus of the second or third aspect, the driving mechanism includes a motion conversion device for converting a rotational motion by the electric motor into a linear motion along a pressing direction, the output unit is linearly moved by the motion conversion device, and the pressure adjustment device is provided between the output unit and the pressing member.

Accordingly, when the rotational motion of the electric motor is converted into a linear motion along a pressing direction by the motion conversion device, a fluctuation occurs in the pressing force and the moving speed generated in the output unit. However, the pressure adjustment device can reduce a fluctuation in pressure in the output unit and allow the pressing member to generate a stable pressing force.

According to the casting mold shaping apparatus of a fifth aspect of embodiments of the present invention, in the casting mold shaping apparatus of the fourth aspect, the motion conversion device includes an eccentric wheel which has a circular-shaped outer ring portion and which is rotationally driven by the electric motor such that around an eccentric rotation center of an eccentric shaft eccentric from a center of the outer ring portion by a predetermined distance, and a link member having one side connected to the outer ring portion of the eccentric wheel so as to be relatively rotatable and the other side connected to the output unit so as to be swingable.

In the present specification, the "eccentric rotation center" means a shaft center of an eccentric shaft eccentric from the center of the eccentric wheel, which is a rotation center when the eccentric wheel is rotating.

Accordingly, the output unit connected to the other side of the link member moves linearly along the pressing direction by the swing rotation of the outer ring portion of the eccentric wheel which rotates around the eccentric rotation center.

In the vicinity of the position where the center of the outer ring portion is vertical to the eccentric rotation center, a fluctuation occurs such that the moving speed of the output unit decreases, whereas the pressure in the pressing direction increases. However, such a fluctuation can be decreased by the pressure adjustment device.

According to the casting mold shaping apparatus of a sixth aspect of embodiments of the present invention, in the casting mold shaping apparatus described in the fifth aspect, the motion conversion device is formed by a pair of the motion conversion devices placed with the shared output unit therebetween, and a synchronization device for respectively rotating the respective eccentric wheels in opposite directions in a synchronous manner, is provided between the two motion conversion devices.

Accordingly, even when an inclined load acts on the output unit by each eccentric wheel, load components in the lateral direction are directed in opposite directions so that the load components are canceled out. Therefore, only a force in the vertical direction acts on the output unit. The output unit can smoothly move in the up-and-down direction without using a special mechanism for guiding in the vertical direction.

According to the casting mold shaping apparatus of a seventh aspect of embodiments of the present invention, in the casting mold shaping apparatus of the second aspect, the driving mechanism includes: a first lowering device that lowers the pressing member to a first position where pressing on casting sands charged into the molding flask is started; and a second lowering device that lowers the pressing member to a second position where pressing on the casting sands in the molding flask is performed and ended.

Accordingly, by dividing the driving mechanism for lowering the pressing member into the first lowering device for simply lowering the pressing member and the second lowering device for actually applying pressure with the pressing member, it is possible to configure the first lowering device as a device to be driven with less power, thereby reducing waste of power.

According to the casting mold shaping apparatus of an eighth aspect of embodiments of the present invention, in the casting mold shaping apparatus of the seventh aspect, the first lowering device includes an eccentric wheel which has a circular-shaped outer ring portion and which is rotationally driven by the electric motor around an eccentric rotation center eccentric from a center of the outer ring portion by a predetermined distance, and a link member having one side connected to the outer ring portion of the eccentric wheel so as to be relatively rotatable and the other side connected to the output unit so as to be rotatable, and a shaft center of the eccentric shaft is disposed on a vertical line passing through the center of the outer ring portion at a bottom dead point that is a lowering end of the eccentric wheel.

Accordingly, the shaft center of the eccentric shaft matches the bottom dead point which is the lowering end of the eccentric wheel it is thus possible to reliably perform the squeezing while preventing the eccentric wheel of the first lowering device from rotating, even when a high load is applied during squeezing by the second lowering device.

According to the casting mold shaping apparatus of a ninth aspect of embodiments of the present invention, that is the casting mold shaping method using the casting mold shaping apparatus of the fifth aspect, one step of pressing the casting sands by the pressing member to make a mold is completed by one rotation of the eccentric wheel in one direction.

Accordingly, when a direction is switched to the rising direction at the squeezing termination end, it is not necessary to decelerate and stop the electric motor and reverse the electric motor. Therefore, it is possible to prevent the loss of the deceleration stop time caused by the reduction and switching of the load on the electric motor due to the increase in the startup and stop frequency.

According to casting mold shaping method of a tenth aspect of embodiments of the present invention, the method for making a mold uses a casting mold shaping apparatus including a driving mechanism with a fluctuation in a force generated in an output unit, and a pressure adjustment device for adjusting a fluctuating force of the driving mechanism outputted to the output unit so as to be suppressed and causing the pressing member to generate a predetermined pressing force necessary for pressing casting sands.

An initial pressing force setting step of setting an initial pressing force of the pressing member for pressing the casting sands charged into the molding space formed by an upper filling frame, a molding flask, a carrier plate to which a pattern is fixed, and a lower filling frame to a value higher than the highest pressing force in a scheduled squeezing, and a back-surface-side preliminary squeezing step of adjusting the pressing force of the pressing member, in a first squeezing to be performed from above the pattern toward a back surface of the pattern, to a first pressing force by the pressure adjustment device, are provided.

A pattern-surface-side squeezing step for adjusting the pressing force of the pressing member, in a second squeezing to be performed upwardly from the pattern surface side, to a second pressing force higher than the first pressing force, and a back-surface-side main squeezing step of adjusting the pressing force of the pressing member, in a third squeezing to be performed from above the pattern toward the back surface of the pattern, to a third pressing force higher than the second pressing force and lower the initial pressing force, are provided.

Accordingly, since the force required for pressing is adjusted by the pressure adjustment device, it is possible to perform three-stage squeezing without adding a special device thereto, simply by setting the initial pressing force higher than the third pressing force.

BRIEF DESCRIPTION

Some of the embodiments will be described in detail, with reference to the following figures, wherein like designations denote like members, wherein.

DETAILED DESCRIPTION

First Embodiment

A first embodiment of a casting mold shaping apparatus and a casting mold shaping method according to the present invention will be described below with reference to FIGS. 1 to 7.

Figure 1:
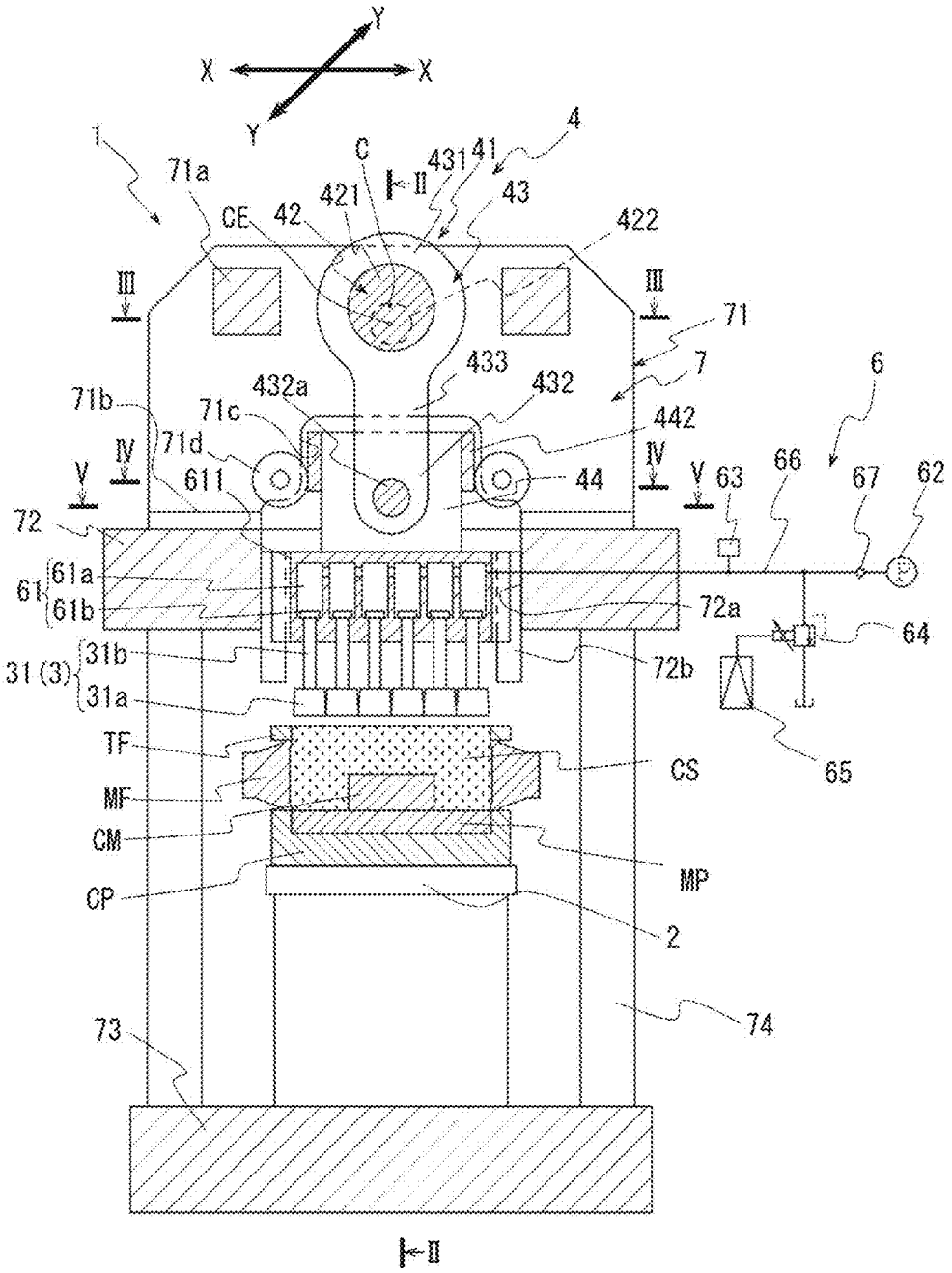
FIG. 1 is a schematic view illustrating a first embodiment of the casting mold shaping apparatus as viewed from a front side shown in a partial cross-sectional view, and is a view illustrating a state before squeezing.
Figure 2:
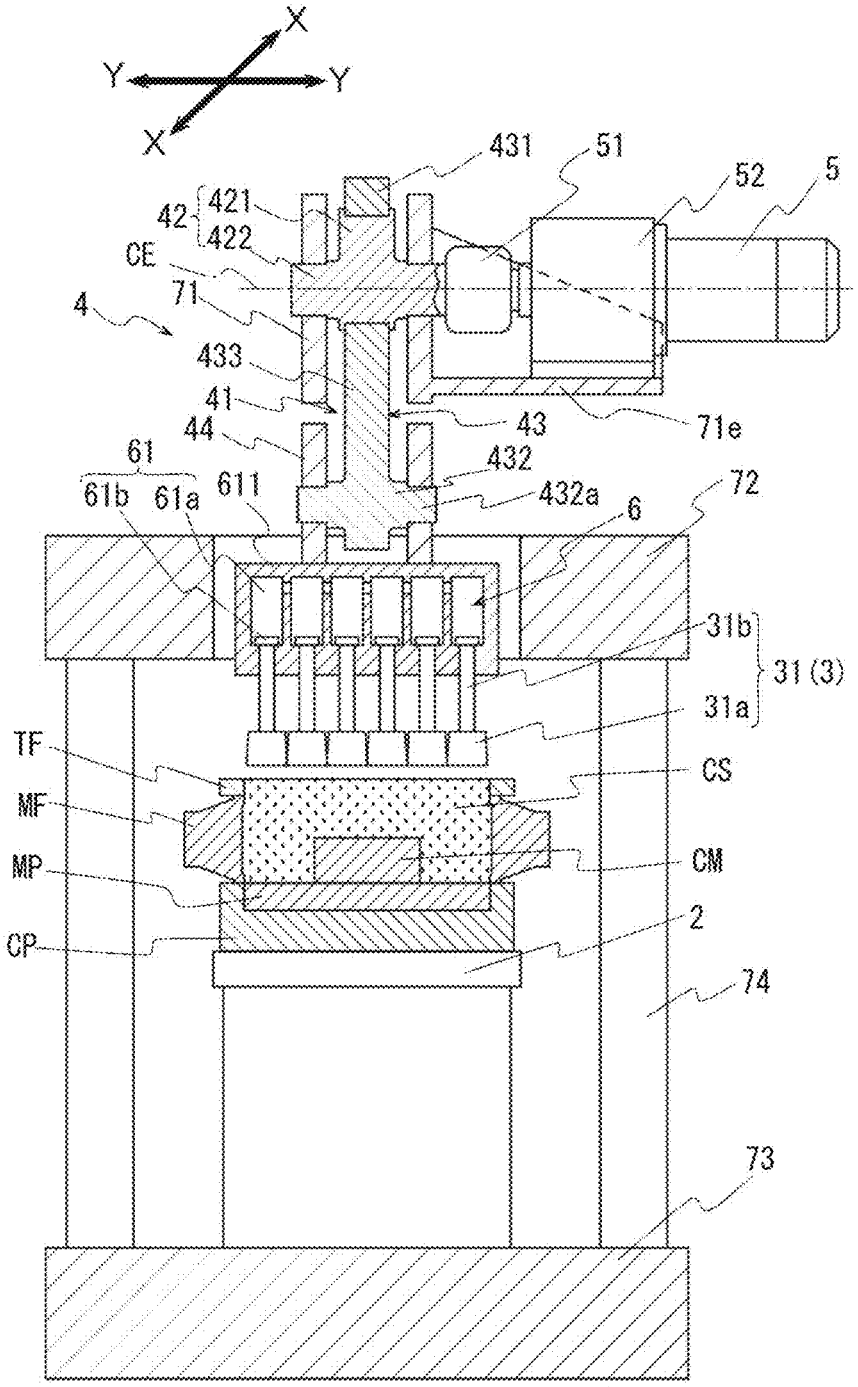
FIG. 2 is a cross-sectional view taken along line II-II in FIG. 1.
Figure 3:
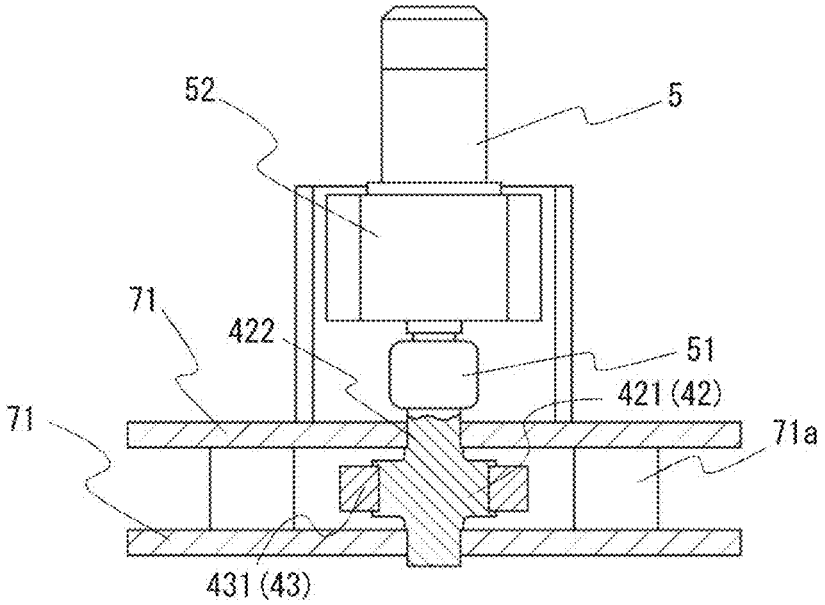
FIG. 3 is a cross-sectional view taken along line III-III in FIG. 1.
Figure 4:
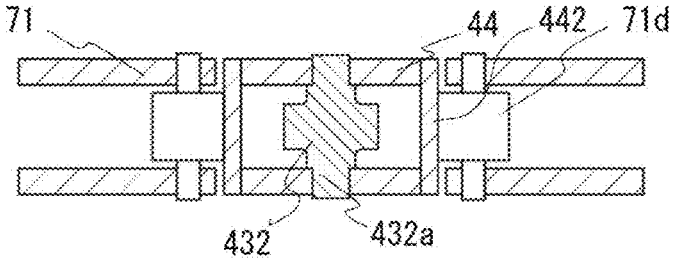
FIG. 4 is a cross-sectional view taken along line IV-IV in FIG. 1.
Figure 5:
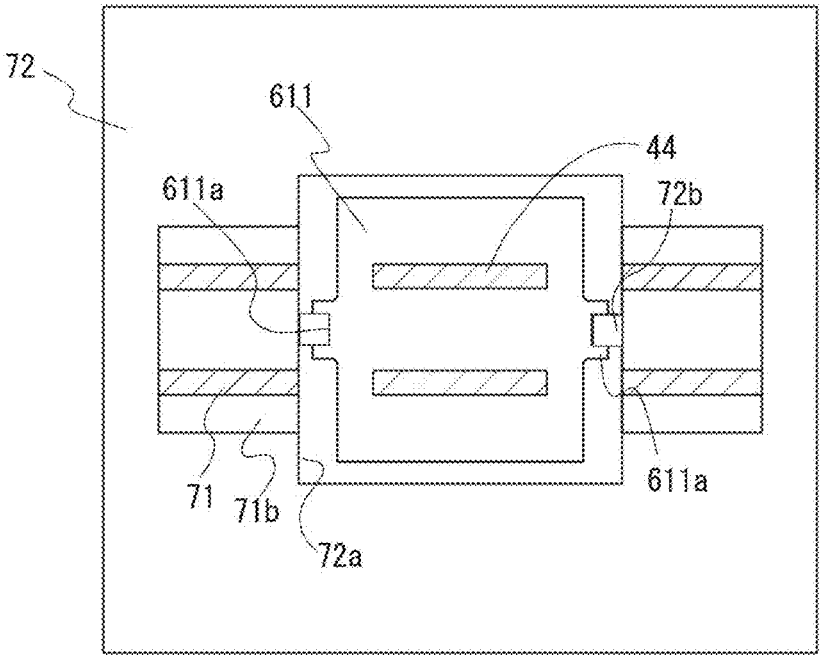
FIG. 5 is a cross-sectional view taken along line V-V in FIG. 1.

As illustrated in FIG. 1, a casting mold shaping apparatus 1 according to the first embodiment includes a squeezing table 2, a pressing member 3, a driving mechanism 4, an electric motor 5, and a pressure adjustment device 6.

Note that, a horizontal direction perpendicular to a rotating shaft (eccentric shaft 422) of the driving mechanism 4 is defined as an X direction, and a horizontal direction perpendicular to the X direction is defined as a Y direction. When there is an object to be conveyed, a virtual center line along a conveyance direction thereof is assumed, and a side close to the center line is referred to as an "inner side", whereas a side far from the center line is referred to as an "outer side".

In the conveyance of a molding flask, a starting point side of the conveyance is referred to as an upstream side, whereas an end point side of the conveyance is referred to as a downstream side.

(Squeezing Table)

The squeezing table 2 has a carrier plate CP, to which a pattern CM and a pattern surface plate MP are fixed, placed thereon and serves as a receiver for the pressing member 3 described later during squeezing. The squeezing table 2 in the present embodiment is a stand having a rectangular cross section fixed to a base 73.

(Pressing Member)

The pressing member 3 presses casting sands CS which have been charged into a molding space configured by an upper filling frame TF, a molding flask MF, a pattern surface plate MP, and the like, thereby compacting the casting sands CS and making a mold using the sands. The casting sands CS are pressed by a downward force output from an output unit 44 of the driving mechanism 4, which will be described later.

The pressing member 3 in the present embodiment is configured by a plurality of squeezing feet 31. Each squeezing foot 31 includes a pressing portion 31*a* having a substantially cubic shape and a rod portion 31*b*, and a plurality of the pressing portions 31*a* are gathered and arranged in a rectangular shape so as to press the casting sands CS with lower surfaces of the pressing portions 31*a*.

A lower end of the bar-shaped rod portion 31*b* is integrally connected to an upper section of each pressing portion 31*a*. An upper end of the rod portion 31*b* is connected to a piston portion 61*b* of a pressure adjustment device 6 described later. The rod portion 31*b* is configured to advance and retract downwardly through an opening of a cylinder portion 61*a* of the pressure adjustment device 6 described later.

(Upper Filling Frame)

The upper filling frame TF is stacked and held on the molding flask MF so that the casting sand CS, which is put into the molding space in extra to use the pressing stroke for squeezing, does not spill out. After the molding is finished in the molding flask MF, the upper filling frame TF is removed from the molding flask MF.

The upper filling frame TF is made of, for example, iron and is formed in a rectangular frame shape.

Since the molding flask MF and the pattern surface plate MP are well-known techniques, the description thereof will be omitted.

(Electric Motor)

The electric motor 5 drives the driving mechanism 4 described later. The electric motor 5 is fixed to a bracket portion 71*e* projecting in the Y direction on a back side of a support standing wall 71 of a structure body (see FIG. 2).

As the electric motor 5, for example, it is possible to use an induction motor. The induction motor is a type that does not require complicated control like a servomotor. As described above, a transmission 52 is provided on an output shaft (not illustrated) of the electric motor 5, and an output portion of the transmission 52 is connected to the eccentric shaft 422 of the driving mechanism 4 described later via a coupling 51.

(Driving Mechanism)

The driving mechanism 4 transmits a rotational torque of the electric motor 5 to the pressing member 3 as a pressing force.

The driving mechanism 4 includes a motion conversion device 41 and the output unit 44.

(Motion Conversion Device)

The motion conversion device 41 converts the rotational motion of the electric motor 5 into a linear motion of the output unit 44.

The motion conversion device 41 includes an eccentric wheel 42 and a connecting rod (hereinafter, referred to as a conrod 43). The conrod 43 corresponds to a link member.

The eccentric wheel 42 is made of, for example, iron and includes an outer ring portion 421 and the eccentric shaft 422. The outer ring portion 421 is formed in a circular plate shape, and one end portion (large end portion 431) of the conrod 43 serving as a link member is externally fitted and connected to a circumferential section of the outer ring portion 421 so as to be freely rotatable relative to each other. The eccentric wheel 42 rotates about an eccentric rotation center CE provided at the rotation center of the eccentric shaft 422.

The eccentric shaft 422 is provided at a position eccentric from the center C of the outer ring portion 421 by a predetermined distance. The stroke length of the eccentric wheel 42 is twice the predetermined distance of eccentricity. The eccentric shaft 422 is formed so as to project in a direction perpendicular to the circumferential section of the outer ring portion 421 from both front and back sides (see FIG. 2). The eccentric shaft 422 is pivotally supported by a bearing of the support standing wall 71 of the structure body 7. One side of the eccentric shafts 422 is connected to the transmission 52 connected to the output shaft of the electric motor 5 via the coupling 51 as described above (see FIG. 3).

(Conrod)

The conrod 43 connects the output unit 44 and the eccentric wheel 42, and converts the rotational motion of the eccentric wheel 42 into a linear motion of the output unit 44.

The conrod 43 is made of, for example, iron and includes a large end portion 431 provided on one side, a small end portion 432 provided on the other side, and a connecting portion 433 connecting the large end portion 431 and the small end portion 432. The large end portion 431, the small end portion 432, and the connecting portion 433 are integrally formed.

The large end portion 431 is formed in a ring shape, and is externally fitted to the outer circumference of the outer ring portion 421 of the eccentric wheel 42 so as to be freely rotatable relatively. The small end portion 432 is provided with a connecting shaft 432*a* formed in parallel to the central axis of a ring of the large end portion 431. The connecting shaft 432*a* is freely rotatably connected to a bearing hole provided at an upper section of the output unit 44 described later (see FIG. 4).

The connecting portion 433 is formed in a flat bar shape with a predetermined length and connects the large end portion 431 and the small end portion 432 so as to be relatively immovable.

(Output Unit)

The output unit 44 receives a force of the conrod 43 and linearly reciprocates in an up-and-down direction. A lower end of the output unit 44 is connected to an upper end of a raising and lowering frame 611 with a bolt (not illustrated) or the like.

The output unit 44 is made of, for example, iron, and is formed in a rectangular frame shape having a space in the center when viewed from above. In addition, the output unit 44 is formed in a square shape when viewed from the front (see the front view in FIG. 1).

In the output unit 44, a bearing hole into which the connecting shaft 432*a* is inserted is formed at a central portion when viewed from the front so as to be concentrically communicated with the front surface side and the back surface side. The bearing hole is provided with a bearing (not illustrated).

A pair of guide side walls 442 extending in the up-and-down direction are provided on upper sections of two lateral surfaces arranged in the X direction in the output unit 44. The guide side walls 442 roll when a guide roller 71*d* provided on an inner wall 71*c* of the structure body 7 described later comes into contact therewith. The output unit 44 can perform a linear reciprocating movement in the up-and-down direction by the guide side walls 442 and the guide roller 71*d*.

(Structure Body)

The structure body 7 plays a role of supporting the squeezing table 2, the pressing member 3, the driving mechanism 4, the electric motor 5, and the pressure adjustment device 6.

The structure body 7 is made of, for example, iron and formed in a turret shape, and includes the support standing wall 71, a top plate portion 72, the base 73, and a support column 74.

The base 73 is formed by a rectangular-shaped plate, and the columnar-shaped support columns 74 are provided to stand from four corners of the base 73.

The respective support columns 74 support the rectangular-shaped top plate portion 72 that is horizontally provided, at four corners. A rectangular shaped through hole 72*a* is provided in the center portion of the top plate portion 72, and the raising and lowering frame 611 of the hydraulic cylinder device 61 described later is accommodated in the through hole 72*a* so as to be able to pass therethrough (see FIG. 5).

A guide rail 72*b* extending in a vertical direction is provided on each of vertical surfaces, of the through hole 72*a*, arranged in the Y direction and facing each other. The guide rail 72*b* is slidably fitted in a guide groove 611*a* of the raising and lowering frame 611 described later, and the raising and lowering frame 611 moves up and down along the guide rail 72*b*.

The support standing wall 71 is provided to stand on the upper surface of the top plate portion 72.

The electric motor 5 is placed in the abovementioned bracket portion 71*e* of the support standing wall 71 so as to support the large end portion 431 of the conrod 43, and thus, the support standing wall 71 supports the output unit 44 connected to the conrod 43, the pressing member 3, and the pressure adjustment device 6.

The support standing wall 71 is formed by two substantially-rectangular-shaped plate members extending along the X direction and arranged in the Y direction. The two plate members are connected by two connecting bridges 71*a* at upper sections thereof. The two plate members are connected by a plate-shaped leg 71*b* extending along the Y direction at the lower end portions thereof.

The support standing wall 71 has a pair of the inner walls 71*c* facing two lateral surfaces, of the output unit 44, arranged in the X direction. The inner walls 71*c* extend along the vertical direction, and a guide roller 71*d* that rolls when being in contact with the surface of the guide side wall 442 of the output unit 44, is provided at a lower section of each inner wall 71*c*.

The guide roller 71*d* has the following functions.

In the conrod 43, since the large end portion 431 rotates so as to be eccentric from the rotation center, an inclined load which is inclined obliquely with respect to the verticality is generated in the output unit 44. Therefore, in the output unit 44, a phenomenon in which a lateral load that is a lateral-directional component of the inclined load, is largely applied to one side and is less applied to the other side, occurs.

Accordingly, different frictional forces are generated on both sides, of the output unit 44, in the X direction, and smooth sliding is not performed. Therefore, the guide roller 71*d* is configured to smoothly slide even if the applied load is different.

An upper end portion of the pressure adjustment device 6 described later is connected to the lower end of the output unit 44.

(Pressure Adjustment Device)

The pressure adjustment device 6 performs adjustment so as to suppress a fluctuating force of the driving mechanism 4, and allows the pressing member 3 to generate a stable and necessary predetermined pressing force.

The pressure adjustment device 6 includes a hydraulic cylinder device 61, a hydraulic pump 62, a pressure sensor 63, a pressure control valve 64, and a pressure command amplifier 65.

(Hydraulic Cylinder Device)

The hydraulic cylinder device 61 includes the raising and lowering frame 611, the cylinder portion 61*a*, and the piston portion 61*b*. The raising and lowering frame 611 is made of, for example, iron and formed in a three-dimensionally square shape, and a plurality of the cylinder portions 61*a* formed in a cylindrical shape and extending in the vertical direction are provided side by side to form a rectangular shape inside the raising and lowering frame 611. The guide grooves 611*a* extending in the vertical direction are provided on outer lateral surfaces arranged in the Y direction of the raising and lowering frame 611 (see FIG. 5).

The hydraulic cylinder device 61 is provided so as to correspond to each of the plurality of squeezing feet 31 described above. An upper end of the rod portion 31*b* of the squeezing foot 31 is connected to the piston portion 61*b*.

In the plurality of hydraulic cylinder devices 61, the respective cylinder portions 61*a* are communicated with each other through an oil passage 66, and a hydraulic force by each hydraulic cylinder device 61 uniformly acts on all the cylinder portions 61*a*.

The cylinder portion 61*a* is filled with oil, and when the squeezing foot 31 presses the casting sands CS with the pressing portion 31*a* at the tip thereof, the pressing force is regulated by the hydraulic pressure (that is, back pressure described later acting on the piston portion 61*b*) in the cylinder portion 61*a*. The plurality of cylinder portions 61*a* are communicated with one hydraulic pump 62 through the oil passage 66.

(Pressure Sensor, Pressure Control Valve)

The pressure sensor 63 is provided between the cylinder portion 61*a* and the hydraulic pump 62. The pressure sensor 63 detects the pressure on the back pressure side of the hydraulic cylinder device 61. A branch oil passage connected to the pressure control valve 64 is provided between the pressure sensor 63 and the hydraulic pump 62. The pressure control valve 64 functions as a pressure reducing valve that reduces the pressure on the basis of a specific pressure value instructed from the connected pressure command amplifier 65.

The pressure control valve 64 reduces a fluctuating pressure to be inputted to the output unit 44 and the raising and lowering frame 611 by the driving mechanism 4 so as to become a constant pressure in the back pressure of the hydraulic cylinder device 61. The pressure to be inputted to the output unit 44 and the raising and lowering frame 611 by the driving mechanism 4 is set to a value slightly higher than the pressure required for pressing and is executed. The setting of the pressure to be inputted by the driving mechanism 4 is performed through the calculation based on the output of the electric motor 5, the structure of the motion conversion device 41, and the like. In an embodiment, a case where the pressure required for pressing is 10 MPa, the pressure to be inputted by the driving mechanism 4 is set to 12 MPa.

When the squeezing foot 31 applies pressure to the casting sands, the pressure adjustment device 6 detects the back pressure acting on a rear end side of the squeezing foot 31 by the secondary-side pressure sensor 63, and in a case where the detected back pressure exceeds a predetermined pressure value, the pressure adjustment device 6 discharges oil from the oil passage 66 communicated with the cylinder portion 61*a* so as to reduce the back pressure to a set pressure value.

(Hydraulic Pump)

The hydraulic pump 62 is disposed at a terminal portion of the oil passage 66 via a check valve 67. The hydraulic pump 62 is used to return the squeezing foot 31 retracted to the cylinder portion 61*a* side to an advancing end that is the initial position during the operation of pressing the casting sands CS described later. The pressure used to return the squeezing foot 31 to the initial position may be, for example, approximately 1 MPa, and thus, the amount of power for driving the hydraulic pump 62 can be extremely small.

(Control Device)

The control device (not illustrated) drives the electric motor 5, controls the rotation position of the eccentric shaft 422, and controls the discharge amount of the pressure control valve 64 via the pressure command amplifier 65 based on a signal from the pressure sensor 63.

(Operation)

An operation of the casting mold shaping apparatus 1 will be described below with reference to FIGS. 1, 2, 6, and 7.

First, FIG. 1 illustrates a state before the casting mold shaping apparatus 1 performs squeezing. The outer ring portion 421 of the eccentric wheel 42 is fixed at a top dead point. The conrod 43 is held at the rising end, and the output unit 44, the raising and lowering frame 611, and the pressing member 3 (squeezing foot 31) connected to the conrod 43 are also held at the rising end position.

Below the pressing member 3, a so-called stacked frame is formed by stacking the carrier plate CP, the molding flask MF, and the upper filling frame TF on the squeezing table 2. The casting sands CS are charged into the stacked frame by a charging device (not illustrated). The casting sands CS are piled up to the position of an upper end portion of the upper filling frame TF.

Each squeezing foot 31 of the driving pressing member 3 driven by the hydraulic pump 62 is held at the lowermost end with respect to the cylinder portion 61*a* in a state of being pressed by the hydraulic pressure in the cylinder portion.

The control device prepares for causing the driving mechanism 4 to output with the calculated numerical value so that the pressing member 3 performs pressing with the initial pressing force.

Figure 6:
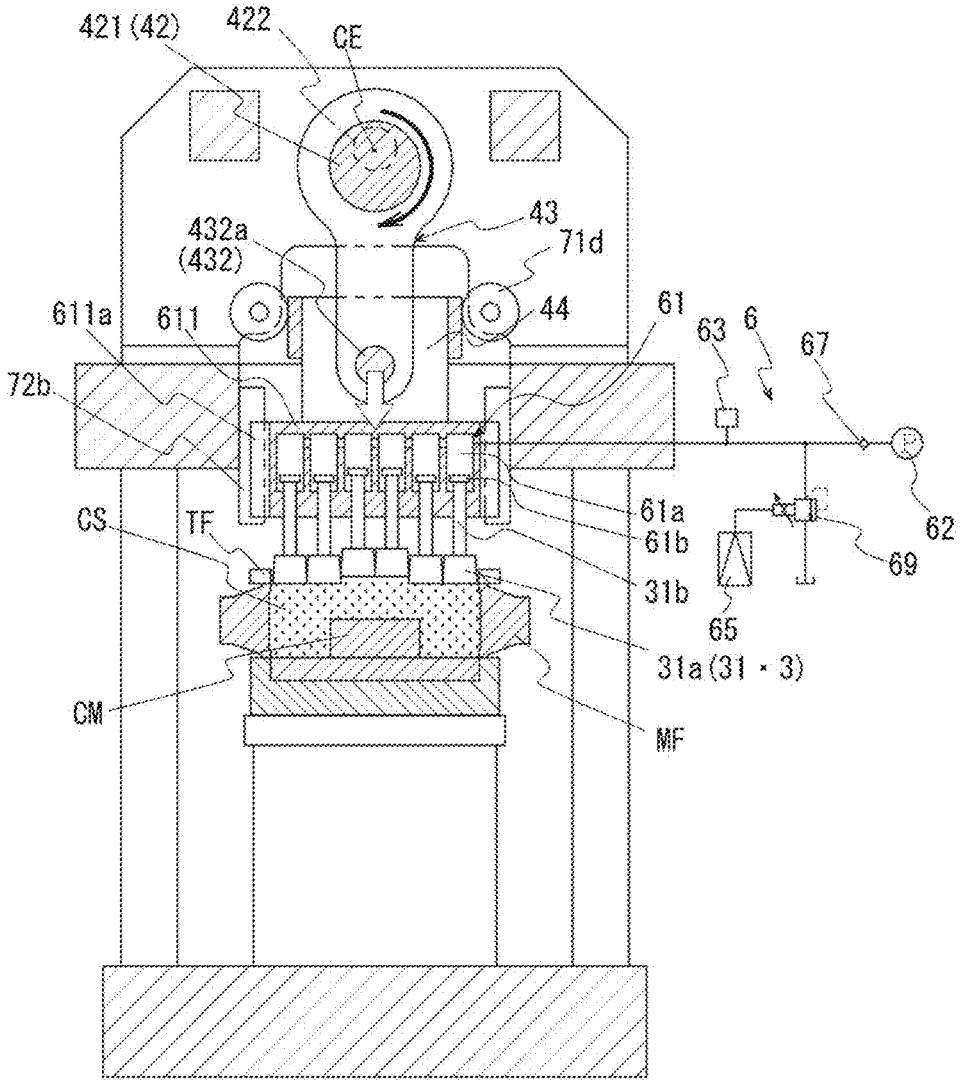
FIG. 6 is a view illustrating a state in which squeezing in the first embodiment is performed as viewed from the front side.
Figure 7:
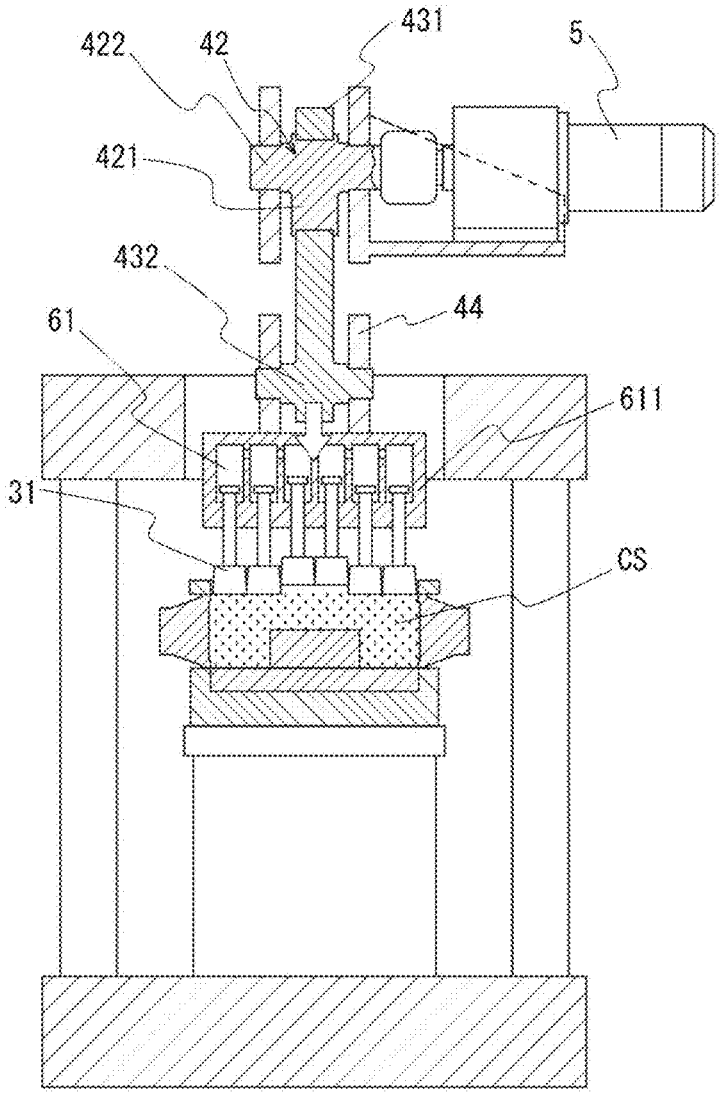
FIG. 7 is a view illustrating a state in which squeezing in the first embodiment is performed as viewed from a lateral surface side.

Next, the control device drives the electric motor 5 to rotate the eccentric wheel 42. As illustrated in FIG. 6, when being rotated by 180 degrees, the raising and lowering frame 611 is lowered to the lowermost end so as to press (squeeze) the casting sands CS by the squeezing foot 31 (see FIG. 7).

When pressing the casting sands CS, the pressing portion 31*a* presses the casting sands CS at a predetermined necessary pressure. At this time, in a case where a pressing force with a predetermined pressure or more is applied, such a case is detected by the pressure sensor 63, and oil that generates an excessive pressure is discharged by the pressure control valve 64 so as to reduce the pressure. Then, it becomes possible to achieve squeezing with a desired pressing force.

A portion having a small thickness of the casting sands CS facing the pattern CM is pressed to a shallow position by the corresponding squeezing foot 31, whereas a portion having a large thickness of the casting sands CS is pressed to a deep position by the squeezing foot 31.

Next, the control device further rotates the eccentric wheel 42 by 180 degrees in the same direction. As a result, the raising and lowering frame 611 is raised to the rising end position, and one step of squeezing is terminated.

As is obvious from the above description, the casting mold shaping apparatus 1 according to the first embodiment of the present invention includes the pressing member 3 for pressing the charged casting sands CS in the molding space formed by the molding flask MF and the carrier plate CP placed on the squeezing table 2, and the driving mechanism 4 for performing driving so as to bring the pressing member 3 and the squeezing table 2 close to each other or separate the pressing member 3 and the squeezing table 2 from each other, the driving mechanism 4 including the output unit 44 that moves along a direction of pressing the pressing member 3.

Furthermore, the electric motor 5 for driving the driving mechanism 4, and the pressure adjustment device 6 for adjusting a force of the driving mechanism 4 outputted to the output unit 44 so as to decrease and causing the pressing member 3 to generate a predetermined pressing force necessary for pressing the casting sands CS, are provided.

Accordingly, a force generated when the driving mechanism 4 moves the output unit 44 is adjusted so as to be reduced by the pressure adjustment device 6 and transmitted to the pressing member 3. As a result, it is possible to press the casting sands CS by generating a predetermined pressing force in the pressing member 3 in response to a change in the degree of compression of the casting sands CS or the height of the mold which vary every time molding is performed.

In addition, the driving mechanism 4 is a driving mechanism 4 with the fluctuation in a force generated in the output unit 44, and the pressure adjustment device 6 adjusts a fluctuating force of the driving mechanism 4 outputted to the output unit 44 so as to decrease.

Accordingly, a fluctuating force generated when the driving mechanism 4 moves the output unit 44 is adjusted so as to be reduced by the pressure adjustment device 6 and transmitted to the pressing member 3. As a result, it is possible to stably output the pressing force of the pressing member 3.

In addition, the pressure adjustment device 6 includes a hydraulic cylinder device 61 that receives a pressing force of the pressing member 3 and a pressure control valve 64 that controls the back pressure of the hydraulic cylinder device 61, and the pressing member 3 is configured by a plurality of squeezing feet 31.

Accordingly, the pressing force of the squeezing foot 31 can be adjusted in accordance with the shape of the pattern CM and the properties of the casting sands CS, and the pressing can be performed with an appropriate pressing force.

In addition, the driving mechanism 4 includes a motion conversion device 41 for converting a rotational motion by the electric motor 5 into a linear motion along a pressing direction, and the output unit 44 is linearly moved by the motion conversion device 41.

Accordingly, when the rotational motion of the output shaft of the electric motor 5 is converted into a linear motion along a pressing direction by the motion conversion device 41, a fluctuation occurs in the pressing force and the moving speed generated in the output unit 44. However, the pressure adjustment device 6 can suppress a fluctuation in pressure and generate a stable pressing force.

In addition, the motion conversion device 41 includes the eccentric wheel 42 which has the circular-shaped outer ring portion 421 and which is rotationally driven around the eccentric rotation center CE eccentric from the center C of the outer ring portion 421 by a predetermined distance by the electric motor 5, and the conrod 43 (link member) having one side connected to the outer ring portion 421 of the eccentric wheel 42 so as to be relatively rotatable and the other side connected to the output unit 44 so as to be swingable.

Accordingly, the output unit 44 connected to the other side of the conrod 43 moves linearly along the pressing direction by the swing rotation of the outer ring portion 421 of the eccentric wheel 42. In the vicinity of the position where the center C of the outer ring portion 421 is vertical to the eccentric rotation center CE, a fluctuation occurs such that the moving speed of the output unit 44 decreases, whereas the pressure in the pressing direction increases. However, such a fluctuation can be suppressed by the pressure adjustment device 6.

Furthermore, one step of pressing the casting sands CS by the pressing member 3 to make a mold is completed by one rotation of the eccentric wheel 42 in one direction.

Accordingly, when a direction is switched to the rising direction at the squeezing termination end, it is not necessary to decelerate and stop the electric motor 5 and reverse the electric motor 5. Therefore, it is possible to prevent the loss of the deceleration stop time caused by the reduction and switching of the load on the electric motor 5 due to the increase in the startup and stop frequency.

Second Embodiment

Next, a second embodiment of a casting mold shaping apparatus and a casting mold shaping method according to the present invention will be described below with reference to FIGS. 8-12.

Figure 8:
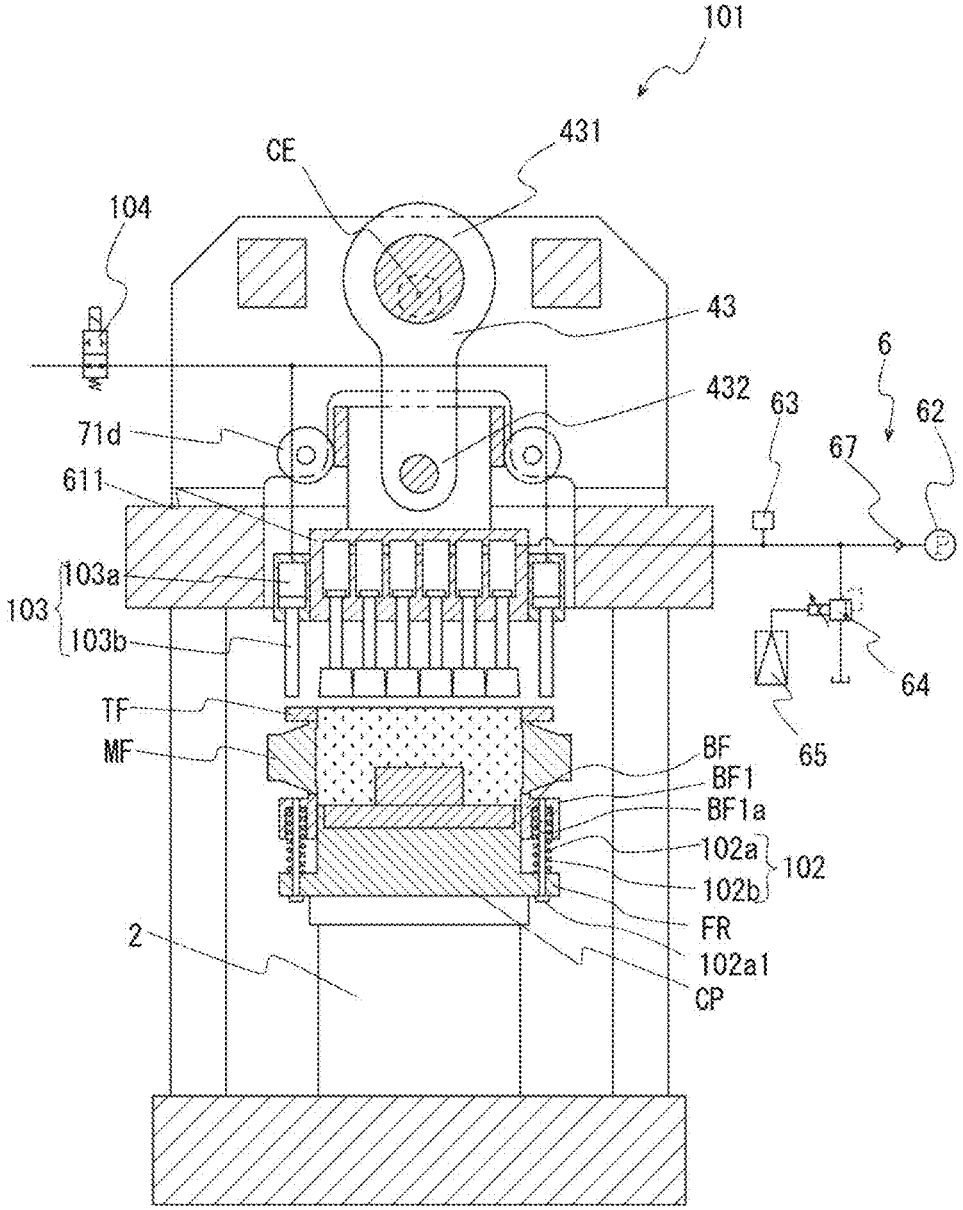
FIG. 8 is a schematic view illustrating a second embodiment of the casting mold shaping apparatus as viewed from the front side shown in a partial cross-sectional view.

As illustrated in FIG. 8, a casting mold shaping apparatus 101 of the second embodiment differs from that of the first embodiment in that a lower filling frame BF, a coil spring 102 between the lower filling frame BF and a carrier plate CP, and a stopper 103 are provided.

Hereinafter, differences will be mainly described.

The lower filling frame BF is provided for charging extra casting sands CS into the molding space, for a stroke of pressing for squeezing from the pattern surface side. Here, the squeezing from the pattern surface side means that the pattern CM and the pattern surface plate press the casting sands CS, relatively upwardly from the upper side surface of the pattern CM, against the casting sands CS filled in the molding space in the stacked frame.

(Coil Spring)

The coil spring 102 between the lower filling frame BF and the carrier plate CP is used to retract the lower filling frame BF downwardly when squeezing is performed from the back surface side. The coil spring 102 includes a bar-shaped guide pole 102*a* and a coil spring main body 102*b* that is externally fitted to the guide pole 102*a*. An upper end of the guide pole 102*a* is attached and fixed to an attachment portion BF1 which projects in the lateral direction at an end portion of the lower filling frame BF. The attachment portion BF1 has a vertical hole BF1*a* which extends in the vertical direction and is opened downwardly, and the upper end portion of the guide pole 102*a* is assembled to a ceiling portion of the vertical hole BF1*a*.

A flange portion FR is provided so as to project at a lower end portion of the carrier plate CP, and a through hole is provided in the flange portion FR. The lower end of the guide pole 102*a* is loosely fitted in the through hole, and is prevented from coming off by a disk-shaped head 102*al* provided at the lower end portion of the guide pole 102*a*. A coil spring main body 102*b* is externally fitted to the guide pole 102*a*, and is disposed in a compressed manner such that a biasing force acts in a direction in which the carrier plate CP and the lower filling frame BF are separated from each other.

Here, the squeezing from the back surface side means that the casting sands CS are pressed by the pressing member 3 from above toward the upper surface of the pattern CM.

(Stopper)

The stopper 103 is used to hold the molding flask MF, the upper filling frame TF, and the lower filling frame BF so as not to move upwardly during the squeezing from the pattern surface side. The stopper 103 in the present embodiment is formed integrally with the raising and lowering frame 611. The stopper 103 includes a stopper cylinder 103*a* and a stopper rod 103*b*. The stopper cylinder 103*a* is communicated with a hydraulic pump (not illustrated), and an electromagnetic switching valve 104 is provided between the hydraulic pump and the stopper cylinder 103*a*. The switching operation of the electromagnetic switching valve 104 is controlled by a control device.

The lower filling frame BF, the coil spring 102 between the lower filling frame BF and the carrier plate CP, and the stopper 103 are all necessary for performing three-stage squeezing, and are publicly-known technologies, and thus, detailed description thereof will be omitted. The functions of the coil spring 102 and the stopper 103 will be described in the following operations.

(Operation)

A step of making a mold using the casting mold shaping apparatus 101 having the above configuration will be described below with reference to FIGS. 8-12.

Firstly, an initial pressing force of the pressing member 3 is set.

The initial pressing force is a pressure that can be outputted by the output unit 44 when moving downwardly, and is outputted mainly based on the electric motor 5 and the transmission 52.

Firstly, the initial pressing force is set so that a pressure larger than the scheduled main squeezing from the back surface side is outputted. As illustrated in FIG. 8, oil is supplied from the hydraulic pump 62 to each cylinder portion 61*a* of the hydraulic cylinder device 61 to become in a fully-filled state.

Figure 9:
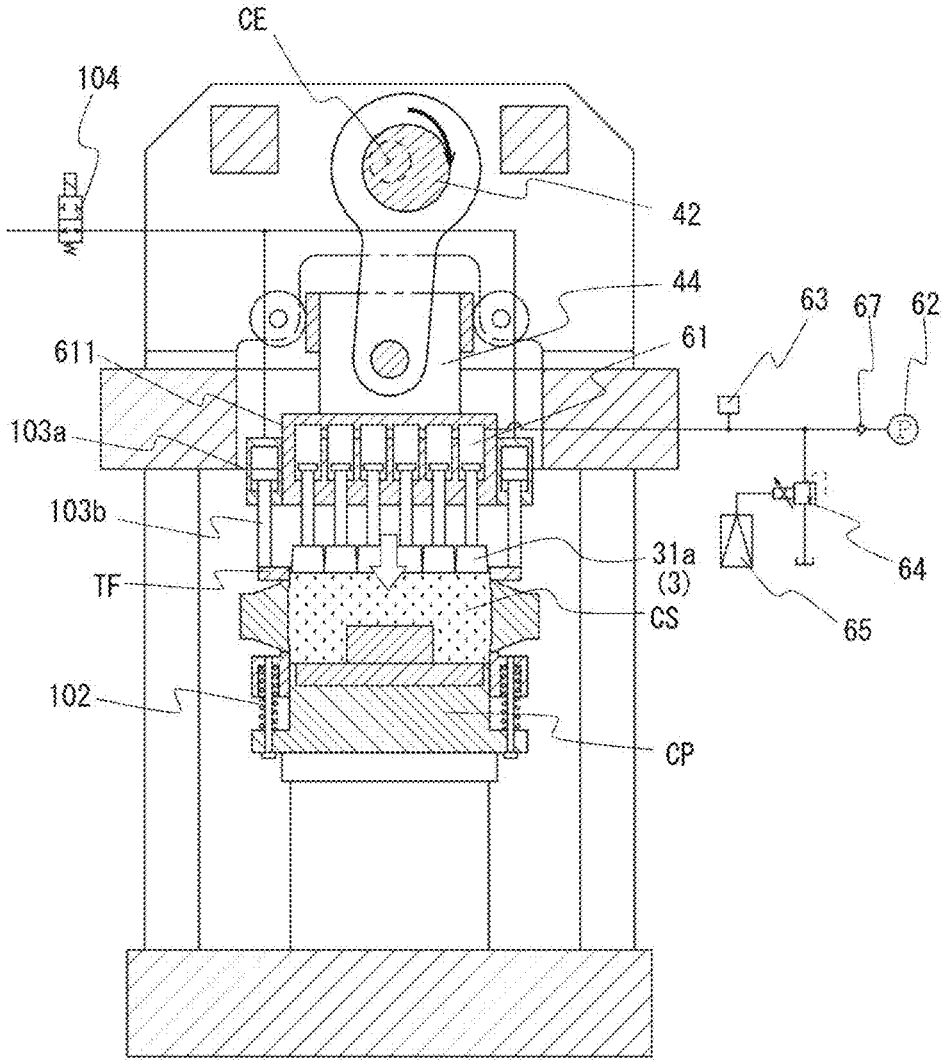
FIG. 9 is a view illustrating a state in which a preliminary squeezing step is performed in the second embodiment.

Next, as illustrated in FIG. 9, the control device performs first squeezing from above the pattern CM toward the back surface of the pattern CM. The eccentric wheel 42 is rotated clockwise to lower the raising and lowering frame 611 and the stopper 103. The pressure adjustment device 6 detects the back pressure discharged from the cylinder portion 61*a* by the pressure sensor 63 communicated with the hydraulic cylinder device 61, and adjusts the amount of oil discharged by the pressure control valve 64 to become larger or smaller, thereby controlling the pressure of the pressing member 3 to adjust the pressure to the first pressing force (back-surface-side preliminary squeezing step).

In a case where the eccentric wheel 42 drives the conrod 43, for example, immediately before and immediately after the eccentric rotation center CE of the eccentric wheel 42 and the center C of the outer ring portion 421 are arranged on a vertical line, the speed of moving the output unit 44 in the vertical direction is slow, whereas a state where the largest force is outputted as the pressing force is achieved.

In addition, for example, the speed becomes the fastest at a time point when the center of the eccentric wheel 42 and the center C of the outer ring portion 421 are arranged on a horizontal line after the start.

However, the pressing force at the time point when the eccentric rotation center CE of the eccentric wheel 42 and the center C of the outer ring portion 421 are arranged on the horizontal line, is smaller than the pressing force immediately before and immediately after the eccentric rotation center CE of the eccentric wheel 42 and the center C of the outer ring portion 421 are arranged on the vertical line.

At the time point when the eccentric rotation center CE of the eccentric wheel 42 and the center C of the outer ring portion 421 are arranged on the horizontal line, the center C of the outer ring portion 421 is shifted in the horizontal direction from the eccentric rotation center CE of the eccentric wheel 42 that is the rotation center, and thus, a force (inclination load) is applied to the output unit 44 not vertically, but obliquely. Therefore, while the eccentric wheel 42 is rotating, a fluctuation occurs in the output unit 44 in which the force, the direction, and the speed vary.

Such a fluctuation in the output unit 44 is detected by the pressure sensor 63 as the back pressure of the hydraulic cylinder device 61, and the amount of oil discharged from the hydraulic cylinder device 61 is controlled by the pressure control valve 64, thereby performing adjustment such that an appropriate pressing force occurs.

Figure 10:
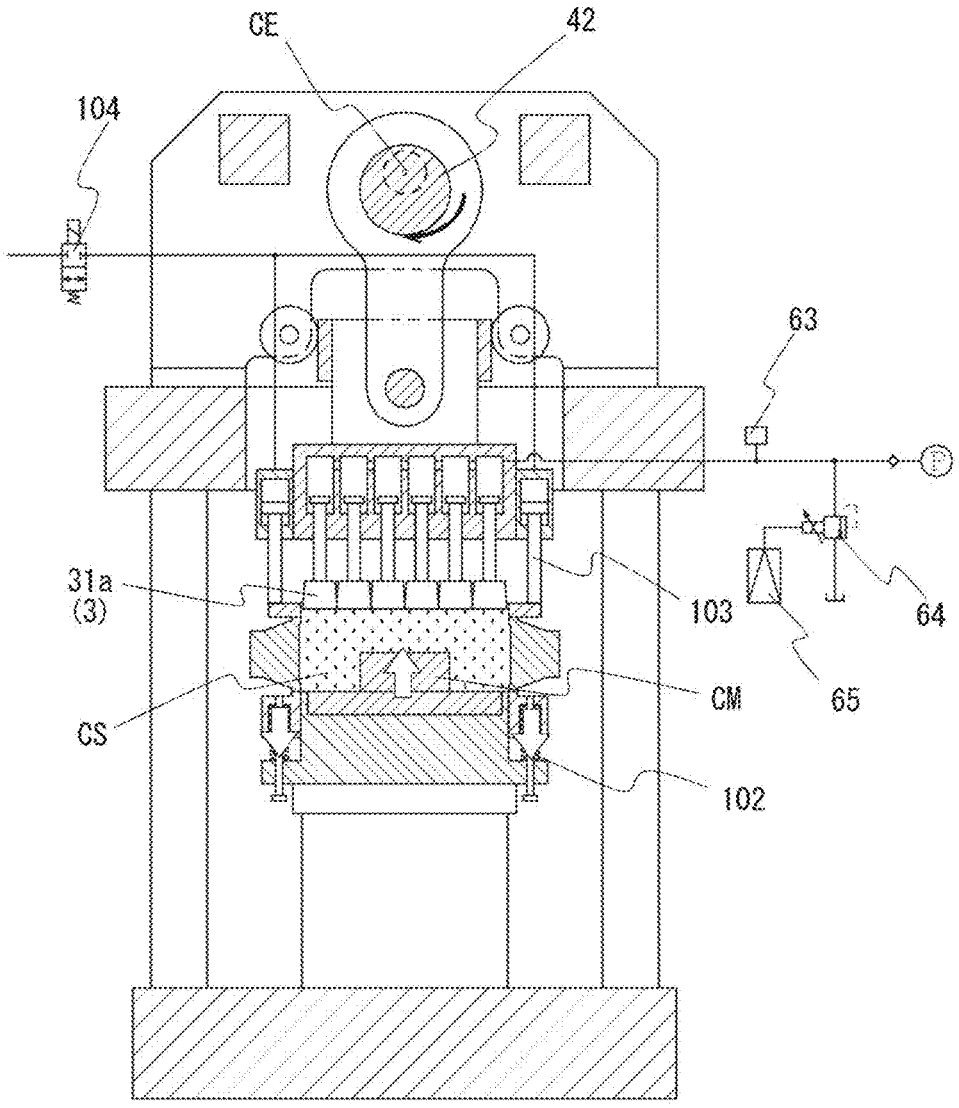
FIG. 10 is a view illustrating a state in which squeezing from a pattern surface side is performed.

Next, as illustrated in FIG. 10, the control device performs second squeezing by further rotating the eccentric wheel 42. In the second squeezing to be performed upwardly (relatively) from the pattern CM surface side, the pressing force of the pressing member 3 is adjusted to a second pressing force higher than the first pressing force (pattern-surface-side squeezing step).

The second pressing force is also controlled by the pressure control valve 64 via the pressure command amplifier 65 based on a command from the control device.

In the second squeezing, the pressing member 3 presses the casting sands CS in the molding flask MF, and the stopper cylinder 103*a* is fixed in a state where hydraulic pressure is being applied by the electromagnetic switching valve 104, and the stopper 103 suppresses a relative rise of the upper end of the upper filling frame TF. In that case, the pressing is performed by an amount corresponding to a pressing margin of the lower filling frame BF while fighting against a resilient force of the coil spring 102.

Although not illustrated in FIG. 10, a structure is provided in which the upper surface of the lower filling frame BF is not lowered below the upper surface position of the pattern surface plate MP.

Then, the control device detects, with a position sensor (not illustrated), that the upper surface of the lower filling frame BF is flush with the upper surface of the pattern surface plate MP and the lower filling frame BF is at a lowering end, and stops the rotation of the eccentric wheel 42. Control is performed such that the rotation of the eccentric wheel 42 is gradually decelerated and then stopped.

As a result, the surface of the pattern CM is allowed to rise relative to the molding flask MF, and it becomes possible to perform squeezing from the pattern surface side. The casting sands CS are pressed based on a pressing margin provided in the lower filling frame BF. Depending on the shape of the pattern CM, it becomes possible to perform uniformly squeezing even in a portion where filling of the casting sands CS is difficult.

Figure 11:
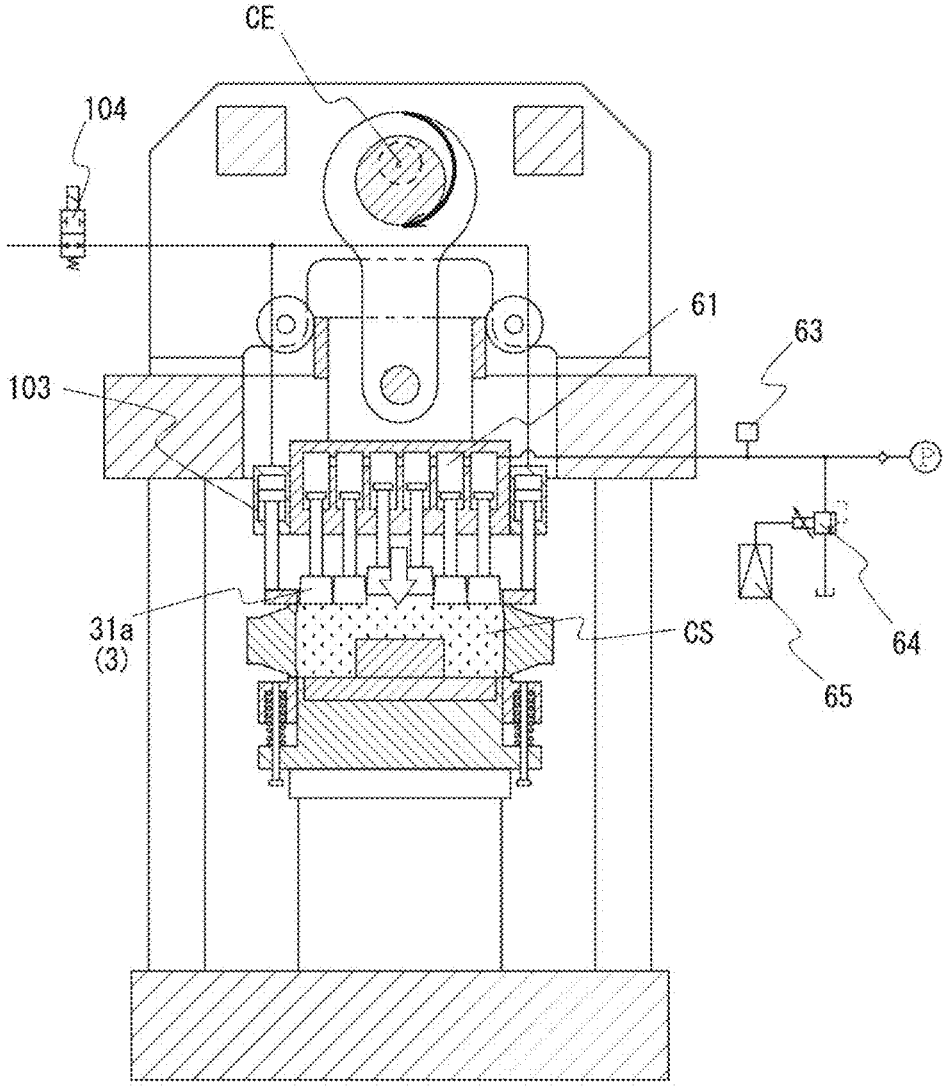
FIG. 11 is a view illustrating a state in which main squeezing from a rear surface side is performed.

Next, as illustrated in FIG. 11, the control device rotates the eccentric wheel 42 again, and performs a third squeezing to be performed from above the pattern CM toward the back surface of the pattern CM (back-surface-side main squeezing step).

In this case, the control device sets the pressure control valve 64 so as to output the pressing force of the pressing member 3 to be higher than the second pressing force and lower than the initial pressing force.

In the control device, the pressing member 3 presses an amount corresponding to the depth of the pressing margin provided on the upper filling frame TF.

Also in this embodiment, the pressure adjustment device 6 provided between the pressing member 3 and the output unit 44 performs adjustment so as to suppress a fluctuating force of the driving mechanism 4, and causes the pressing member 3 to generate a predetermined pressing force necessary for pressing the casting sands CS.

Figure 12:
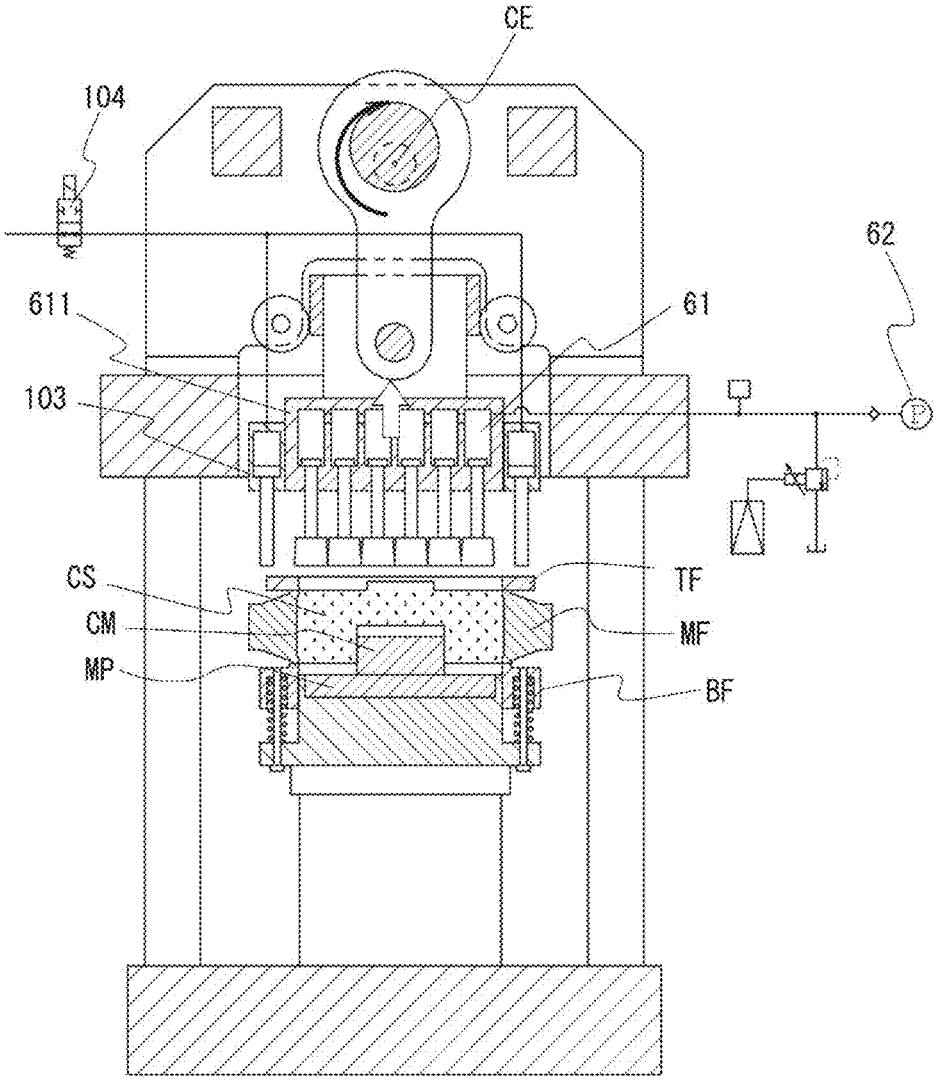
FIG. 12 is a view illustrating a state in which a pressing member is raised.

Next, as illustrated in FIG. 12, the control device rotates the eccentric wheel 42 to raise the raising and lowering frame 611 and the stopper 103 to the rising end position. A mold made after the compaction is separated from the pattern CM and the pattern surface plate MP together with the molding flask MF by the coil spring 102 and is transferred to the next step.

As is obvious from the above description, the casting mold shaping apparatus 101 according to the second embodiment can perform the following casting mold shaping method.

An initial pressing force setting step of setting an initial pressing force of the pressing member 3 for pressing the casting sands CS charged into the molding space formed by the upper filling frame TF, the molding flask MF, the carrier plate CP to which the pattern CM is fixed, and the lower filling frame BF to a value higher than the scheduled highest pressing force, is provided.

A back-surface-side preliminary squeezing step of adjusting the pressing force of the pressing member 3, in a first squeezing to be performed from above the pattern CM toward a back surface of the pattern CM, to a first pressing force by the pressure adjustment device 6, and a pattern-surface-side squeezing step for adjusting the pressing force of the pressing member 3, in a second squeezing to be performed upwardly from the pattern surface side, to a second pressing force higher than the first pressing force, are provided.

A back-surface-side main squeezing step of adjusting the pressing force of the pressing member 3, in a third squeezing to be performed from above the pattern CM toward the back surface of the pattern CM, to a third pressing force higher than the second pressing force and lower the initial pressing force, is provided.

Accordingly, since the force required for pressing is adjusted by the pressure adjustment device 6, it is possible to perform three-stage squeezing without adding a special device thereto, simply by setting the initial pressing force higher than the third pressing force.

Third Embodiment

Next, a third embodiment of a casting mold shaping apparatus according to the present invention will be described below with reference to FIGS. 13-16.

A driving mechanism 204 of a casting mold shaping apparatus 201 in the third embodiment includes a first lowering device 211 and a second lowering device 212.

(First Lowering Device)

Figure 15:
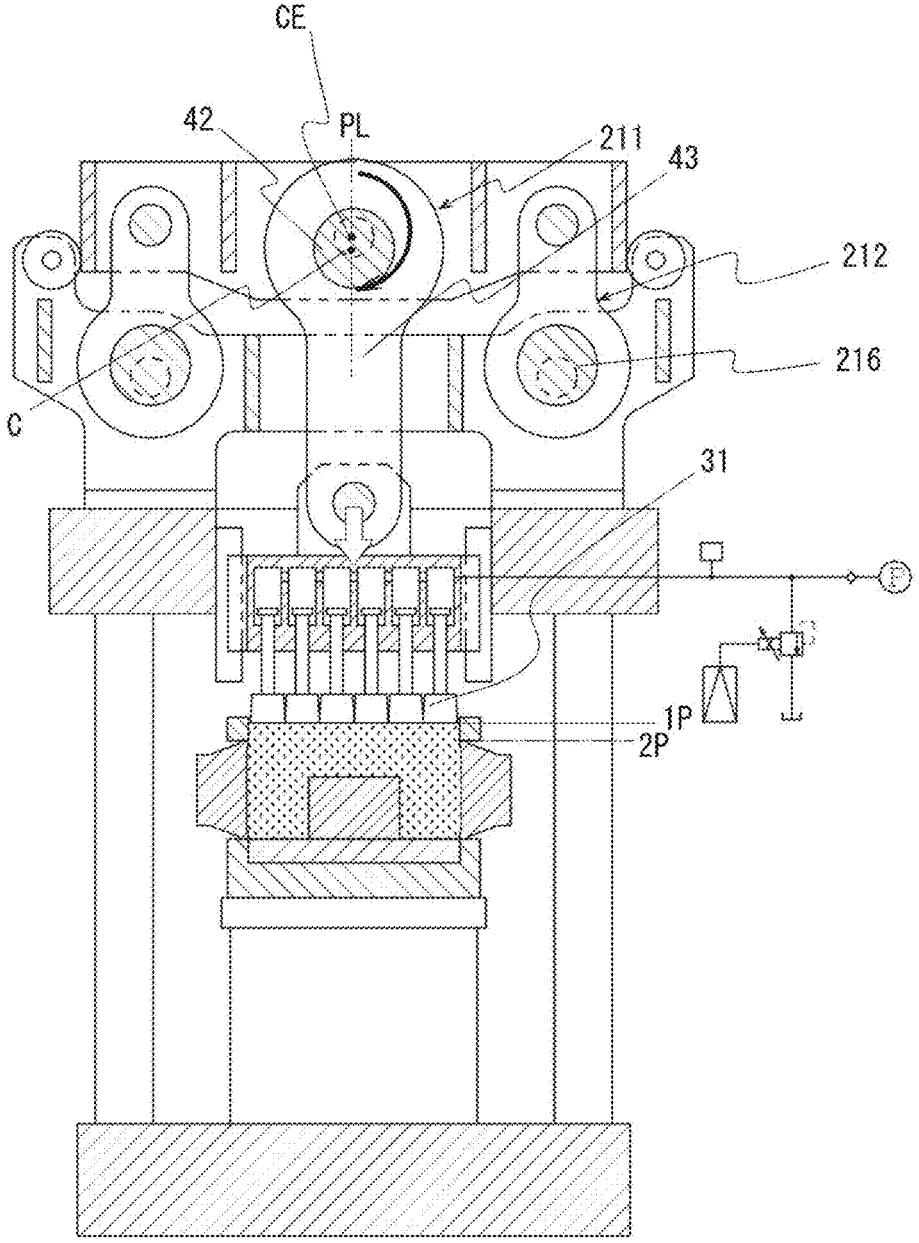
FIG. 15 is a view illustrating a state in which the pressing member is lowered to a first position.

The first lowering device 211 lowers the pressing member 3 from the rising end position to a first position 1P where an arrival at the upper surface of the casting sands CS charged into the molding flask MF is achieved (see FIG. 15).

The configuration of the first lowering device 211 is similar to that of the motion conversion device 41 of the driving mechanism 4 in the first embodiment. However, the eccentric shaft 422 of the eccentric wheel 42 is freely rotatably supported by a bearing (not illustrated) provided on a support slider 214 described later. In this point, there is a difference from the motion conversion device 41 in the first embodiment. The center C of the outer ring portion 421 in the eccentric wheel 42 is disposed on a vertical line PL together with the eccentric rotation center CE at a bottom dead point that is the lowering end of the eccentric wheel 42 (see FIGS. 15 and 16).

Figure 14:
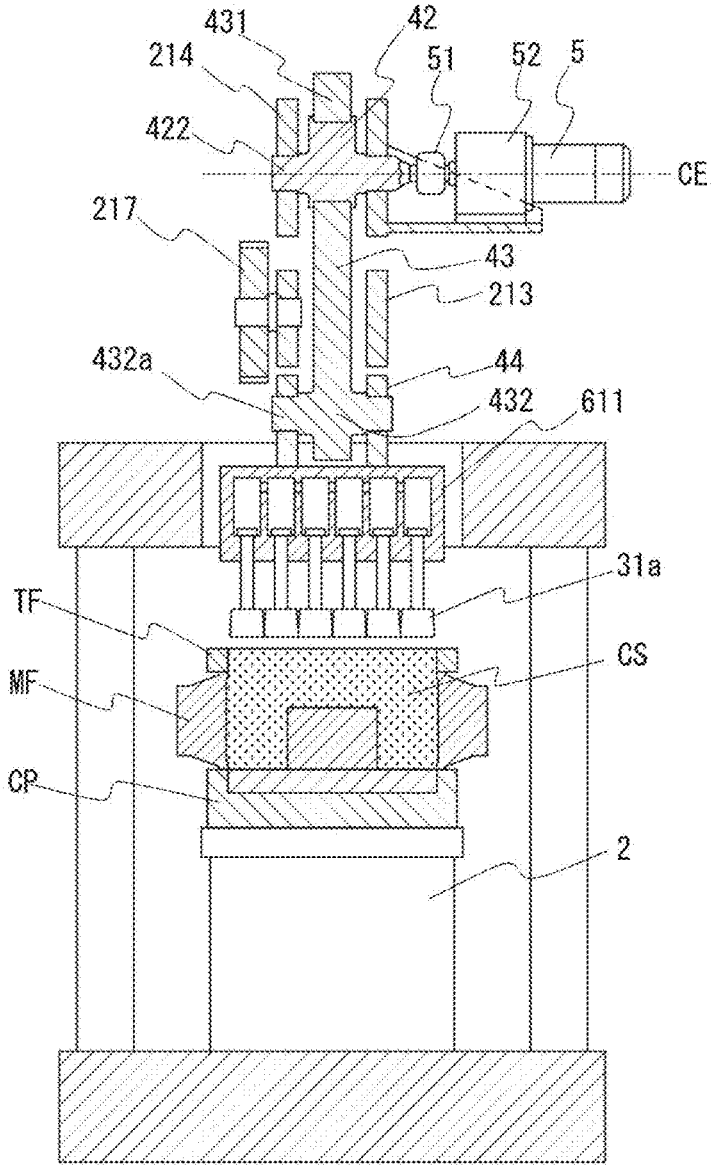
FIG. 14 is a view of the third embodiment as viewed from the lateral surface side shown in a partial cross-sectional view.

As the electric motor 5 used for driving the first lowering device 211, an electric motor having output performance lower than that of the electric motor 5 in the first embodiment is used (see FIG. 14).

Since the other configurations are similar to those of the motion conversion device 41 in the first embodiment, the same reference numerals are given thereto and the description thereof is omitted.

(Second Lowering Device)

Figure 16:
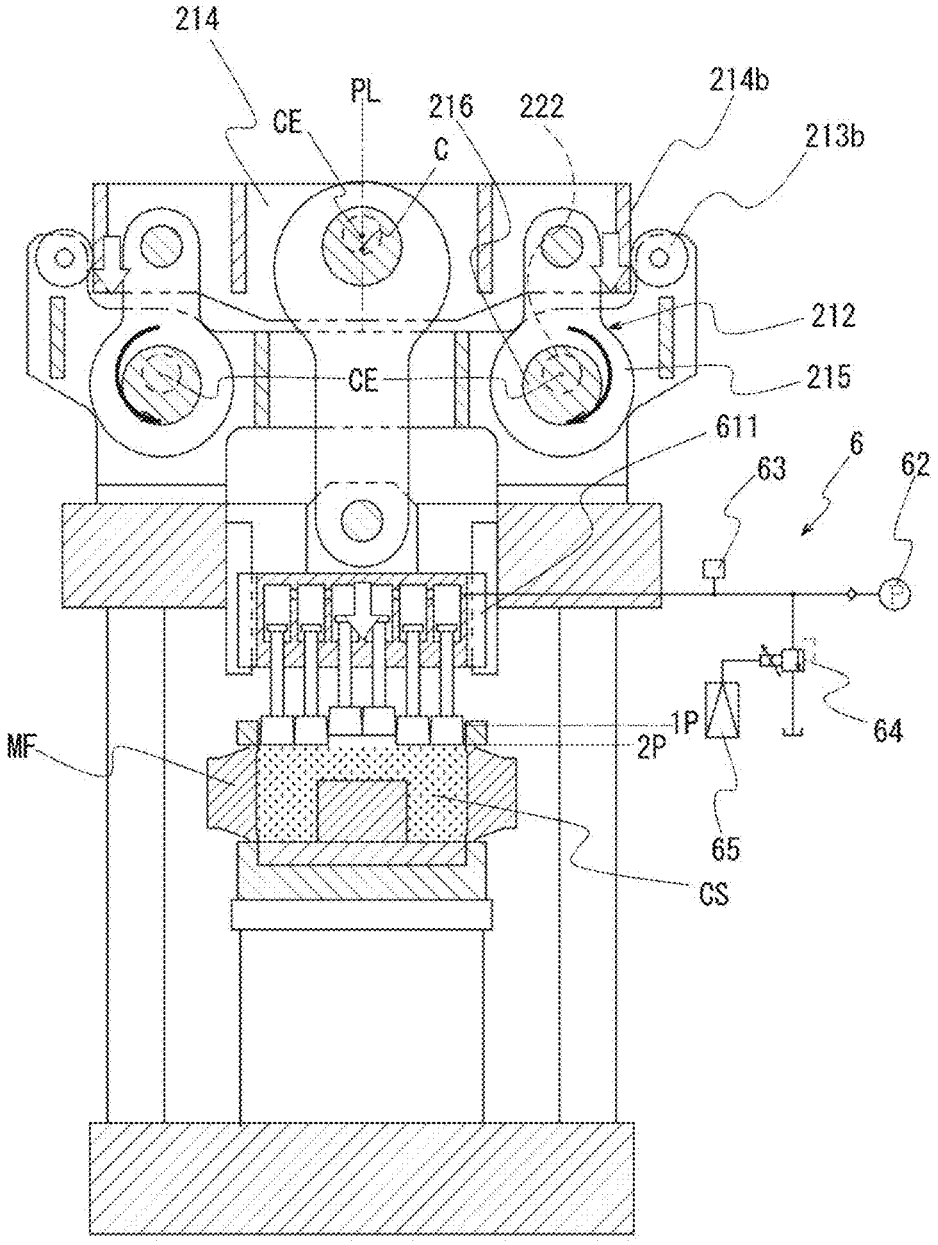
FIG. 16 is a view illustrating a state in which the pressing member is lowered to a second position.

The second lowering device 212 lowers the pressing member 3 from the first position 1P where an arrival at the upper surface of the casting sands CS charged into the molding flask MF is achieved, to a second position 2P where squeezing is performed (see FIG. 16).

Figure 13:
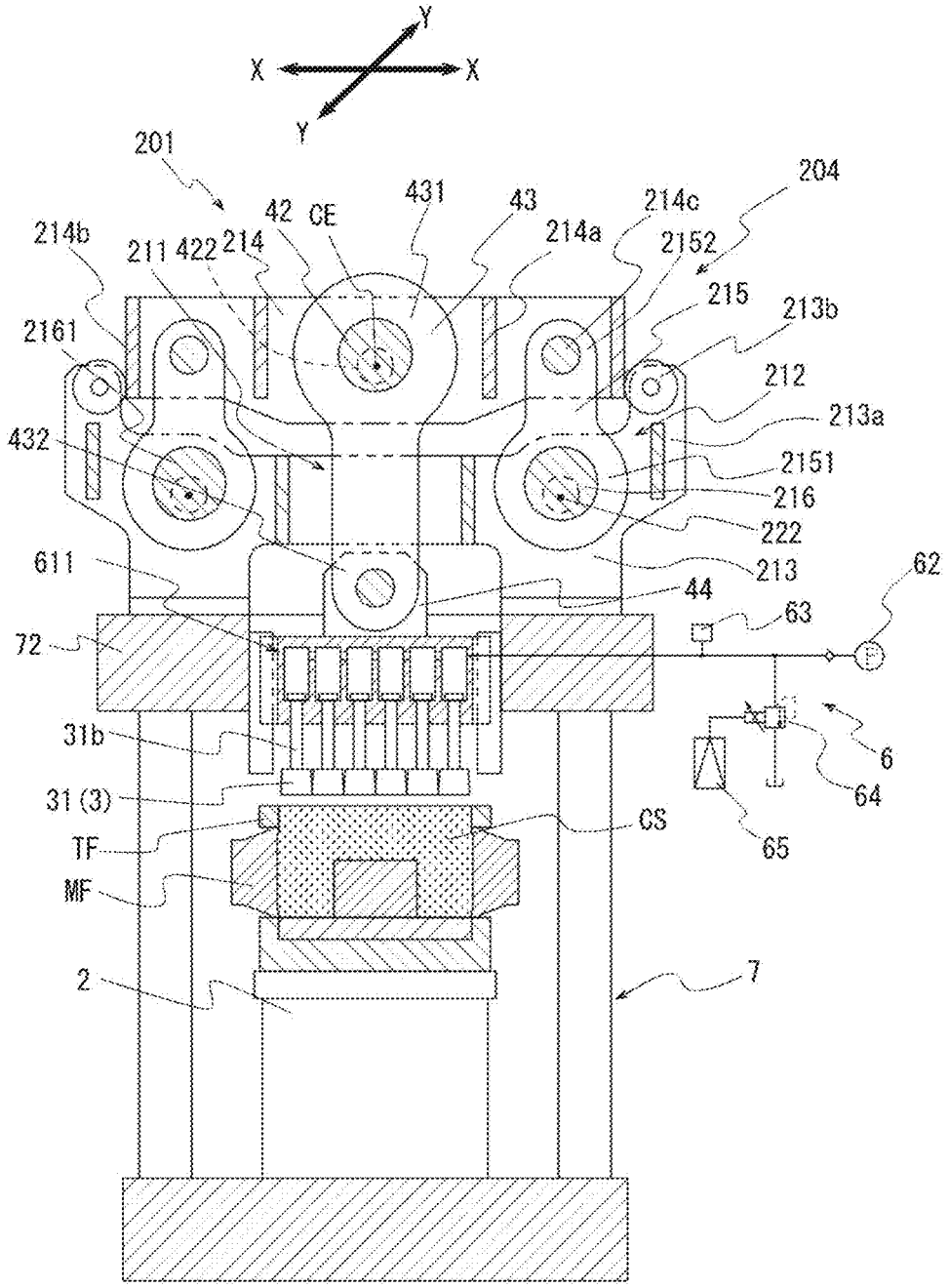
FIG. 13 is a schematic view illustrating a third embodiment of the casting mold shaping apparatus as viewed from the front side shown in a partial cross-sectional view.

As illustrated in FIG. 13, the second lowering device 212 includes a slider support column 213, a support slider 214, a second conrod 215, a second eccentric wheel 216, a synchronization gear 217 (see FIG. 14), and a second electric motor 205.

(Slider Support Column)

The slider support column 213 is fixed to the top plate portion 72 of the structure body 7, and supports a support slider 214 described later via a pair of second eccentric wheels 216 and a pair of second conrods 215.

As illustrated in FIG. 13, the slider support column 213 is formed in a substantially H shape as viewed from the front by using, for example, double plate materials made of iron and arranged along the Y direction. The slider support column 213 is provided to stand on the upper surface of the top plate portion 72 of the structure body 7 such that two leg portions are arranged along the X direction. Bearings for supporting a second eccentric shaft 222 of the second eccentric wheel 216 are provided at both ends respectively at a middle height position.

Arm portions 213*a* extending upwardly so as to be separated from each other are provided at tips on both sides of the slider support column 213. Tip guide rollers 213*b* are provided at the tips of the arm portions 213*a*. The tip guide roller 213*b* guides the support slider 214 described later so as to smoothly move in the up-and-down direction.

(Support Slider)

The support slider 214 supports the eccentric wheel 42 and the conrod 43 provided in the center. The support slider 214 vertically moves the output unit 44 supported by the conrod 43 in an area between the first position 1P where the pressing member 3 (pressing portion 31*a*) reaches the upper surface of the casting sands CS and the second position 2P where squeezing is performed on the casting sands CS (see FIGS. 15 and 16).

The support slider 214 extends along the X direction, and is formed by stacking two plate members that is made of iron, for example, and that is substantially horizontally long, in a state of being separated by a predetermined length. The two plate members are connected at two positions by a vertical plate-shaped connecting plate portions 214*a* extending in the Y direction. The connecting plate portions 214*a* are provided at positions shifted from the center of the two plate members toward both end sides. Roller rail portions 214*b* extending in the vertical direction are provided respectively at both ends in the X direction between the two plate members.

The roller rail portions 214*b* allow the tip guide rollers 213*b* to come into contact therewith and roll, thereby capable of vertically moving the support slider 214 smoothly.

The eccentric wheel 42 freely rotatably connecting the large end portion 431 of the conrod 43 is fitted, between the two connecting plate portions 214*a*, in the outer ring portion 421. The eccentric shaft 422 of the eccentric wheel 42 is connected to the output shaft of the electric motor 5 via the coupling 51.

Figure 20:
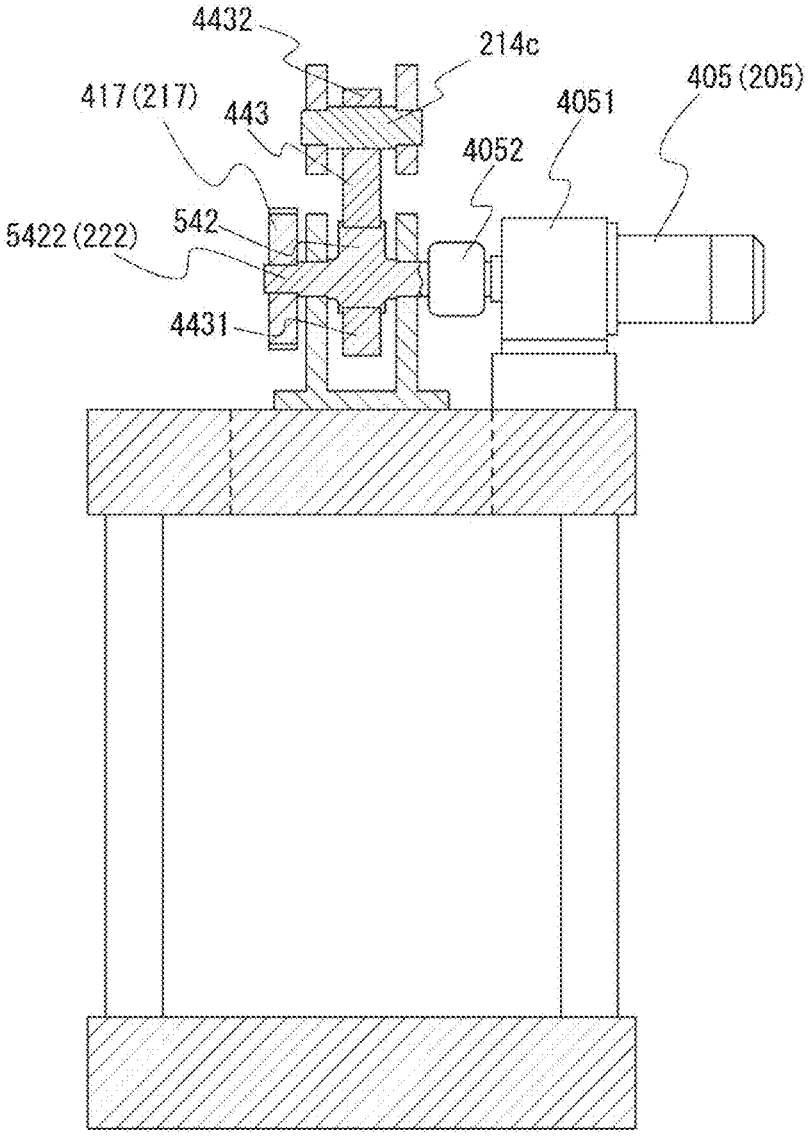
FIG. 20 is a cross-sectional view taken along line XX-XX in FIG. 19.

A support shaft 214*c* for rotatably supporting a small end portion 2152 of the second conrod 215 described later, is provided respectively between the one connecting plate portion 214*a* and the one roller rail portion 214*b* as well as between the other connecting plate portion 214*a* and the other roller rail portion 214*b* (see FIG. 13 and FIG. 20 shown as a substitute).

(Second Conrod)

A pair of second conrods 215 extend in the vertical direction and are disposed side by side in the X direction. A large end portion 2151 of the second conrod 215 is connected to an outer ring portion 2161 of the second eccentric wheel 216 provided on the slider support column 213 so as to be freely rotatable relatively. The small end portion 2152 of the second conrod 215 is rotatably connected to the support shaft 214*c* of the support slider 214 described above.

(Synchronization Gear)

As illustrated in FIGS. 20-23 shown as a substitute, the synchronization gear 217 is provided between the two second eccentric wheels 216 so as to synchronously rotate the two second eccentric wheels 216 in opposite directions.

The synchronization gear 217 is configured by four spur gears 217*a* and 217*b* in total, including the spur gears 217*a* provided respectively on the second eccentric shafts 222 of the two second eccentric wheels 216 in a relatively non-rotatable manner, and the two spur gears 217*b* each provided therebetween along a direction parallel to the rotation center of the second eccentric shaft 222.

The spur gear 217*a* provided in one second eccentric shaft 222, and one of the spur gears 217*b* provided therebetween are engaged with each other, and the one of the spur gears 217*b* is also engaged with the other spur gear 217*b*. The other spur gear 217*b* is engaged with the spur gear 217*a* provided in the other second eccentric shaft 222.

The spur gears 217*a* and 217*b* are formed to have the same number of teeth.

The two second eccentric shafts 222 are configured to synchronously rotate in opposite directions by the spur gears 217*a* and 217*b*.

(Second Electric Motor)

Figure 21:
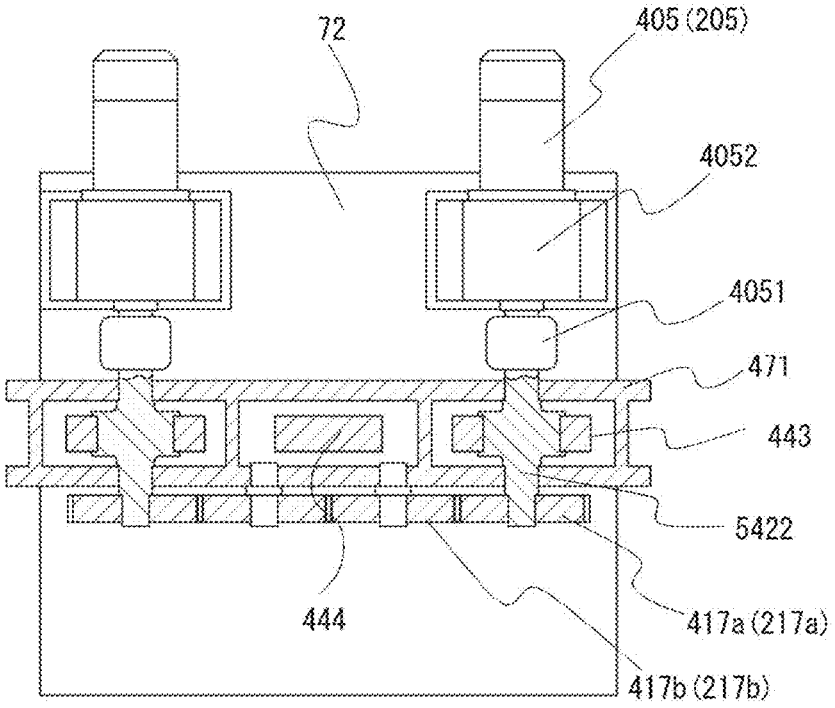
FIG. 21 is a cross-sectional view taken along line XXI-XXI in FIG. 19.

The two second electric motors 205 are arranged along the X direction and fixed to the top plate portion 72 (see FIG. 21 shown as a substitute). Similarly to the eccentric shaft 422 in the first embodiment, the second eccentric shaft 222 is connected to the output shaft of the second electric motor 205 via the transmission 52 and the coupling 51. The two second electric motors 205 having the total output, a value of which is equivalent to that of the electric motor 5 of the first embodiment, are provided.

(Operation)

Next, the operation of the casting mold shaping apparatus of the third embodiment configured as described above will be described with reference to FIGS. 13-16.

First, the eccentric wheel 42 which forms the first lowering device 211 and the second eccentric wheel 216 which forms the second lowering device 212 are in a state where the center C of the outer ring portion thereof is located at a top dead point above a vertical line of the eccentric rotation center CE, and the raising and lowering frame 611 is held at the rising end.

The cylinder portion 61*a* of the hydraulic cylinder device 61 is filled with oil, and the squeezing foot 31 is held at the lower end position of the raising and lowering frame 611.

Next, as illustrated in FIG. 15, the control device rotates the eccentric wheel 42 by 180 degrees to lower the raising and lowering frame 611 to the first position 1P where the pressing portion 31*a* of the pressing member 3 comes into contact with the upper surface of the casting sands CS.

The shaft center (eccentric rotation center CE) of the eccentric shaft 422 is disposed on the vertical line PL passing through the center C of the outer ring portion 421. This serves as the bottom dead point of the eccentric wheel 42.

Next, as illustrated in FIG. 16, the control device rotates the second eccentric wheel 216 by 180 degrees to lower the raising and lowering frame 611 to the second position 2P where squeezing is performed by the pressing portion on the casting sands CS.

The pressure adjustment device 6 detects the back pressure of the hydraulic cylinder device 61 by the pressure sensor 63, and adjusts the pressing force by reducing the pressure by the pressure control valve 64 so that the pressing force which has been set is generated in the pressing member 3.

As is obvious from the above description, the casting mold shaping apparatus 201 according to the third embodiment includes, in the driving mechanism 204, the first lowering device 211 that lowers the pressing member 3 to the first position 1P where an arrival at the upper surface of the casting sands CS charged into the molding flask MF is achieved, and the second lowering device 212 that lowers the pressing member 3 to the second position 2P where pressing on the casting sands CS in the molding flask MF is performed.

Accordingly, by dividing the driving mechanism 204 for lowering the pressing member 3 into the first lowering device 211 for simply lowering the pressing member 3 and the second lowering device 212 for actually applying pressure with the pressing member 3, it is possible to configure the first lowering device 211 as a device to be driven with less power, thereby reducing waste of power.

In addition, the first lowering device 211 includes the eccentric wheel 42 which has the circular-shaped outer ring portion 421 and which is rotationally driven around the eccentric rotation center CE eccentric from the center C of the outer ring portion 421 by a predetermined distance by the electric motor 5, and a link member (conrod 43) having one side connected to the outer ring portion 421 of the eccentric wheel 42 so as to be relatively rotatable and the other side connected to the output unit 44 so as to be rotatable, and the shaft center (eccentric rotation center CE) of the eccentric shaft 422 is disposed on the vertical line PL passing through the center C of the outer ring portion 421 at the bottom dead point that is the lowering end of the output unit 44.

Accordingly, since the eccentric rotation center CE of the eccentric shaft 422 matches the bottom dead point which is the lowering end of the output unit 44, even when a high load is applied during squeezing, it is possible to reliably perform the squeezing while preventing the eccentric wheel 42 of the first lowering device 211 from rotating.

Fourth Embodiment

Next, a fourth embodiment of the casting mold shaping apparatus will be described below with reference to FIGS. 17 and 18.

Figure 17:
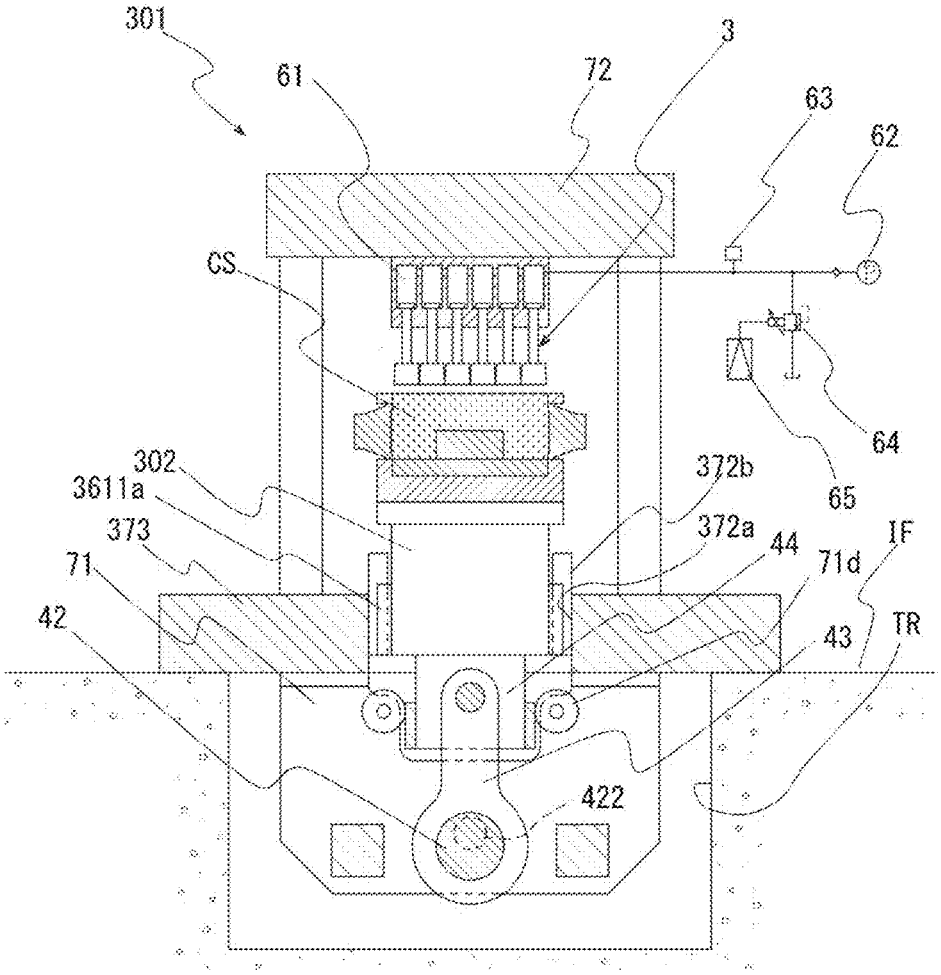
FIG. 17 is a view of a fourth embodiment as viewed from the front surface side shown in a partial cross-sectional view.
Figure 18:
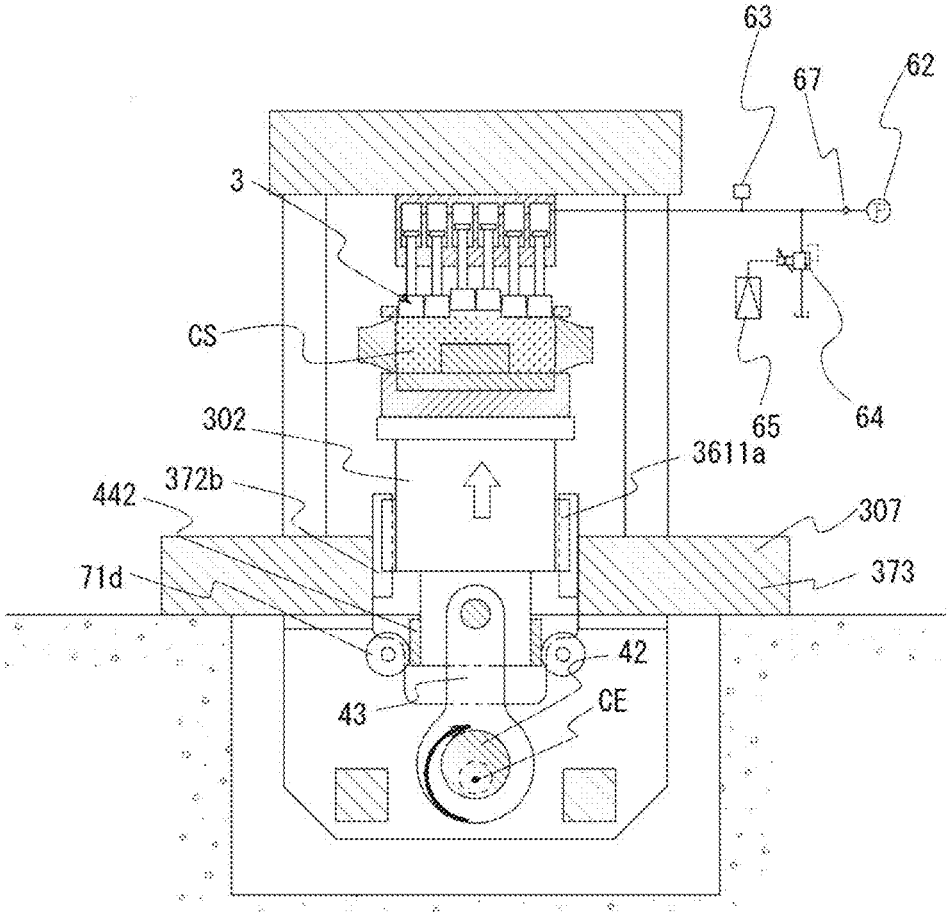
FIG. 18 is a view illustrating a state in which squeezing is performed in the molding apparatus in the fourth embodiment.
Figure 19:
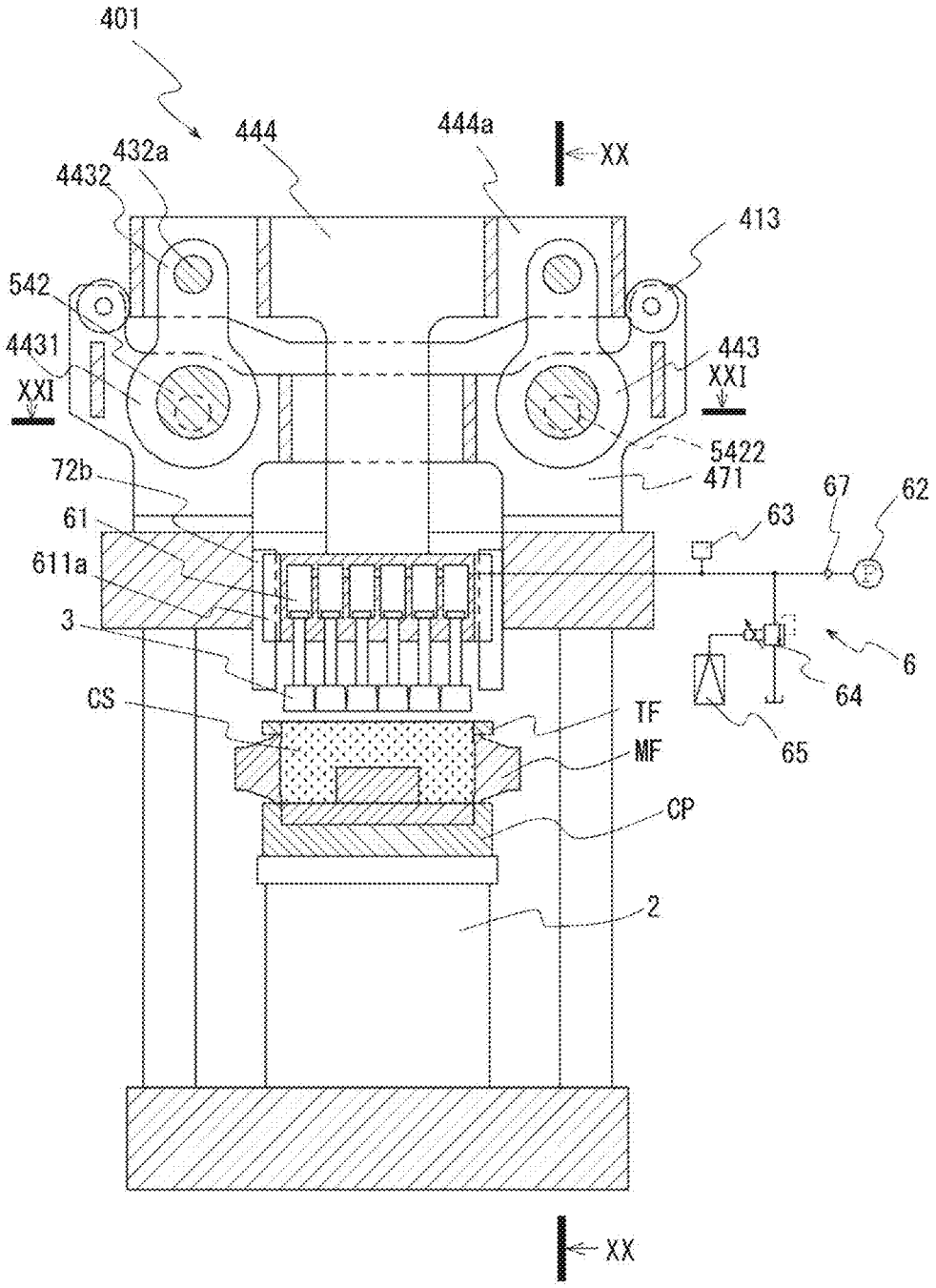
FIG. 19 is a view of a fifth embodiment as viewed from the lateral surface side shown in a partial cross-sectional view.

As illustrated in FIG. 17, in a casting mold shaping apparatus 301 according to the fourth embodiment, a lower section of the squeezing table 302 is connected in series to the output unit 44. The squeezing table 302 having the carrier plate CP placed thereon, is raised (see FIG. 18), and the casting sands CS filled in the stacked molding flask MF are squeezed by the pressing member 3 fixed to the top plate portion 372 thereabove.

In the pressure adjustment device 6, the raising and lowering frame 611 is fixed to a lower surface of the top plate portion 372 of the structure body 307, and the hydraulic cylinder device 61 is provided in the raising and lowering frame 611. Similarly to the first embodiment, each hydraulic cylinder device 61 is provided with a squeezing foot 31.

The driving mechanism 4 is housed in a trench TR formed in an installation floor surface IF. A through hole 372*a* is formed in a base 373, and a guide rail 372*b* is vertically provided in the through hole 372*a* so as to protrude therefrom upwardly. The guide rail 372*b* is slidably fitted in a guide groove 3611*a* provided in the squeezing table 302.

The driving mechanism 4 and the structure body 7 of the casting mold shaping apparatus 1 in the first embodiment are arranged in a vertically inverted state, and the squeezing table 302 is moved up and down, thereby pressing the casting sands CS in the molding flask MF placed on the squeezing table 302 by the pressing member 3 which has been stopped.

Since the other configurations are similar to those of the first embodiment, the same reference numerals are given thereto and the description thereof is omitted.

Accordingly, when it is difficult to find a large space in the up-and-down direction in a layout of the inside of the factory where the casting mold shaping apparatus 301 is installed, space saving can be achieved.

Fifth Embodiment

Next, a fifth embodiment of the casting mold shaping apparatus will be described below with reference to FIGS. 19-22.

In the casting mold shaping apparatus 401 of the fifth embodiment, an output unit 444 is formed in a T shape, and is disposed with a pair of motion conversion devices 441 interposed therebetween. Each motion conversion device 441 is disposed such that the large end portion 4431 of the conrod 443 is placed in a lower part and the small end portion 4432 is placed in an upper part. The small end portion 4432 is connected to an end of a T-shaped horizontal bar portion 444*a* of the output unit 444. That is, the horizontal bar portion 444*a* is held in a state of being laterally bridged across the paired small end portions 4432.

The large end portion 4431 of the conrod 443 is disposed on both sides with the vertical rod portion 444*b* of the output unit 444 interposed therebetween. An eccentric wheel 542 is fitted to the large end portion 4431 of the conrod 443, and each eccentric wheel 542 is connected to an electric motor 405 via a transmission 4052 and a coupling 4051. A synchronization device 417 is provided between the two eccentric wheels 542.

Figure 22:
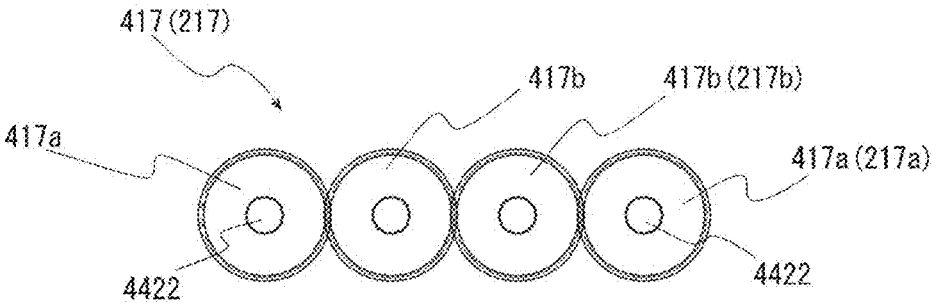
FIG. 22 is a front view illustrating a synchronization device.

As illustrated in FIGS. 21 and 22, the synchronization device 417 is configured by spur gears 417*a* assembled to respective eccentric shafts 5422 so as to be relatively non-rotatable, and two spur gears 417*b* provided between the spur gear 417*a* and the spur gear 417*a*. The two eccentric shafts 5422 synchronously rotate in opposite directions by the spur gears 417*a* and 417*b*.

As described above, since the two eccentric shafts 5422 rotate synchronously and in the opposite directions, even if an inclined load is generated in the two conrods 443, a load in the lateral direction is canceled out and only a load in the vertical direction acts on the output unit 444.

A support wall portion 471 is formed in a substantially H shape, and has rollers 413 provided at both upper end portions. The roller 413 comes into contact with an end portion of the horizontal bar portion 444*a* of the output unit 444 from both sides to guide the movement of the output unit 444 in the up-and-down direction.

Since the other configurations are similar to those of the first embodiment, the same reference numerals are given thereto and the description thereof is omitted.

As is obvious from the above description, in the casting mold shaping apparatus 401 according to the fifth embodiment, the motion conversion device is formed by a pair of the motion conversion devices 441 placed with the shared output unit 444 therebetween, and the synchronization device 417 for respectively rotating the respective eccentric wheels 542 in opposite directions in a synchronous manner, is provided between the two motion conversion devices 441.

Accordingly, even when an inclined load acts on the output unit 444 by each eccentric wheel 542, load components in the lateral direction are directed in opposite directions so that the load components are canceled out. Therefore, only a force in the vertical direction acts on the output unit 444. The output unit 444 can smoothly move in the up-and-down direction without using a special mechanism for guiding in the vertical direction.

Note that, although a component which uses the eccentric wheel 42 is chosen as the driving mechanism 4 that generates fluctuation in the pressing force, the driving mechanism 4 is not limited thereto. In an embodiment, a toggle mechanism and a slider crank mechanism can be used.

Furthermore, although a component which outputs a fluctuating force to the output unit 44 is used as the driving mechanism 4, the driving mechanism 4 is not limited thereto. In an embodiment, a pinion rack mechanism, a ball screw mechanism, a mechanism in which an output unit is linearly driven by a linear motor, or the like can be used.

Although the present invention has been disclosed in the form of embodiments and variations thereon, it will be understood that numerous additional modifications and variations could be made thereto without departing from the scope of the invention.

For the sake of clarity, it is to be understood that the use of "a" or "an" throughout this application does not exclude a plurality, and "comprising" does not exclude other steps or elements. The mention of a "unit" or a "module" does not preclude the use of more than one unit or module.

REFERENCE SIGNS LIST

1 casting mold shaping apparatus
2 squeezing table
3 pressing member
31 squeezing foot
4 driving mechanism
41 motion conversion device
42 eccentric wheel
421 outer ring portion
422 eccentric shaft
43 conrod (link member)
44 output unit
5 electric motor
6 pressure adjustment device
61 hydraulic cylinder device
63 pressure sensor
64 pressure control valve
7 structure body
101 casting mold shaping apparatus
102 coil spring
103 stopper
201 casting mold shaping apparatus
204 driving mechanism
211 first lowering device
212 second lowering device
217 synchronization gear
301 casting mold shaping apparatus
401 casting mold shaping apparatus
405 electric motor
417 synchronization device
441 motion conversion device
442 eccentric wheel
4422 eccentric shaft
443 conrod
444 output unit
1P first position
2P second position
BF lower filling frame
CE eccentric rotation center
CM pattern
CP carrier plate
CS casting sand
MF molding flask
MP pattern surface plate
PL perpendicular line
TF upper filling frame

The invention claimed is:

1. A casting mold shaping apparatus comprising:

a pressing member for pressing charged casting sands in a molding space formed by a molding flask and a carrier plate placed on a squeezing table;

a driving mechanism for performing driving so as to bring the pressing member and the squeezing table close to each other or separate the pressing member and the squeezing table from each other, the driving mechanism including an output unit that moves the pressing member relative to the squeezing table along a direction of pressing the pressing member;

an electric motor for driving the driving mechanism; and a pressure adjustment device for adjusting a force of the driving mechanism outputted to the output unit so as to decrease, causing the pressing member to generate a predetermined pressing force necessary for pressing the casting sands.

2. The casting mold shaping apparatus according to claim 1, wherein:

the driving mechanism makes a fluctuation in a force generated in the output unit, and the pressure adjustment device adjusts the fluctuation in the force of the driving mechanism outputted to the output unit so as to decrease.

3. The casting mold shaping apparatus according to claim 2, wherein:

the pressure adjustment device includes a hydraulic cylinder that receives a pressing force of the pressing member and a pressure control valve that controls a back pressure of the hydraulic cylinder, and the pressing member comprises a plurality of squeezing feet.

4. The casting mold shaping apparatus according to claim 2, wherein:

the driving mechanism comprises a motion conversion device for converting a rotational motion by the electric motor into a linear motion along the direction of pressing;

the output unit is linearly moved by the motion conversion device; and the pressure adjustment device is provided between the output unit and the pressing member.

5. The casting mold shaping apparatus according to claim 4, wherein:

the motion conversion device includes an eccentric wheel which has a circular-shaped outer ring portion and which is rotationally driven by the electric motor around an eccentric rotation center of an eccentric shaft eccentric from a center of the outer ring portion by a predetermined distance, and a link member having one side connected to the outer ring portion of the eccentric wheel so as to be rotatable and the other side connected to the output unit so as to be swingable.

6. The casting mold shaping apparatus according to claim 5, wherein:

the motion conversion device is formed by a pair of the motion conversion devices, wherein a shared output unit is disposed with the pair of the motion conversion devices, and a synchronization device for respectively rotating the respective eccentric wheels in opposite directions in a synchronous manner, provided between the two motion conversion devices.

7. A method for making a mold using the casting mold shaping apparatus according to claim 5, wherein:

one step of pressing the casting sands by the pressing member to make a mold is completed by one rotation of the eccentric wheel in one direction.

8. The casting mold shaping apparatus according to claim 2, wherein the driving mechanism comprises:

a first lowering device that lowers the pressing member to a first position where pressing on casting sands charged into the molding flask is started; and a second lowering device that lowers the pressing member to a second position where pressing on the casting sands in the molding flask is performed and ended.

9. The casting mold shaping apparatus according to claim 8, wherein:

the first lowering device includes;

an eccentric wheel which has a circular-shaped outer ring portion and which is rotationally driven by the electric motor around an eccentric rotation center of an eccentric shaft eccentric from a center of the outer ring portion by a predetermined distance, and a link member having one side connected to the outer ring portion of the eccentric wheel so as to be rotatable and the other side connected to the output unit so as to be rotatable; and the eccentric rotation center of the eccentric shaft is disposed on a vertical line passing through the center of the outer ring portion at a bottom dead point that is a lowering end of the eccentric wheel.

10. A method for making a mold using a casting mold shaping apparatus including a driving mechanism with a fluctuation in a force generated in an output unit, and a pressure adjustment device for adjusting the fluctuation in the force of the driving mechanism outputted to the output unit so as to decrease, causing the pressing member to generate a predetermined pressing force necessary for pressing casting sands, the casting mold shaping method comprising:

an initial pressing force setting step of setting an initial pressing force of the pressing member for pressing the casting sands charged into the molding space formed by an upper filling frame, a molding flask, a carrier plate to which a pattern is fixed, and a lower filling frame to a value higher than a highest pressing force in a scheduled squeezing;

a back-surface-side preliminary squeezing step of adjusting the pressing force of the pressing member, in a first squeezing to be performed from above the pattern toward a back surface of the pattern, to a first pressing force by the pressure adjustment device;

a pattern-surface-side squeezing step for adjusting the pressing force of the pressing member, in a second squeezing to be performed upwardly from the pattern surface side, to a second pressing force higher than the first pressing force; and a back-surface-side main squeezing step of adjusting the pressing force of the pressing member, in a third squeezing to be performed from above the pattern toward the back surface of the pattern, to a third pressing force higher than the second pressing force and lower than the initial pressing force.

* * * * *